US008961289B2

(12) United States Patent
Tsukahara

(10) Patent No.: US 8,961,289 B2
(45) Date of Patent: Feb. 24, 2015

(54) GAMING MACHINE REPRODUCING BET PATTERN AND PLAYING METHOD THEREOF

(75) Inventor: Nakayasu Tsukahara, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1551 days.

(21) Appl. No.: 12/174,255

(22) Filed: Jul. 16, 2008

(65) Prior Publication Data

US 2009/0117965 A1 May 7, 2009

Related U.S. Application Data

(60) Provisional application No. 60/985,455, filed on Nov. 5, 2007.

(51) Int. Cl.
*G07F 17/00* (2006.01)
*G07F 19/00* (2006.01)
*G07F 17/32* (2006.01)

(52) U.S. Cl.
CPC ..... *G07F 17/3286* (2013.01)
USPC ..... 463/17

(58) Field of Classification Search
None
See application file for complete search history.

(56) References Cited

U.S. PATENT DOCUMENTS 5,755,440 A * 5/1998 Sher ..... 273/142 E
5,934,999 A 8/1999 Valdez
6,663,106 B1 12/2003 Cosmi
7,559,838 B2 * 7/2009 Walker et al. ..... 463/21
7,922,576 B2 * 4/2011 Schneider ..... 463/25
8,292,729 B2 * 10/2012 Vlazny et al. ..... 463/25
2002/0142825 A1 * 10/2002 Lark et al. ..... 463/16
2003/0119579 A1 * 6/2003 Walker et al. ..... 463/20
2003/0195043 A1 * 10/2003 Shinners et al. ..... 463/42
2003/0228902 A1 * 12/2003 Walker et al. ..... 463/25
2004/0198487 A1 * 10/2004 Schneider ..... 463/20
2005/0148379 A1 * 7/2005 Huard et al. ..... 463/16
2005/0170886 A1 * 8/2005 Miller ..... 463/28
2005/0181868 A1 * 8/2005 Vlazny et al. ..... 463/28
2006/0252515 A1 * 11/2006 Walker et al. ..... 463/25
2006/0287090 A1 * 12/2006 Ocampo ..... 463/37
2007/0054725 A1 * 3/2007 Morrow et al. ..... 463/16
2008/0032787 A1 * 2/2008 Low et al. ..... 463/29
2008/0096645 A1 * 4/2008 Frerking et al. ..... 463/25
2008/0102936 A1 * 5/2008 Okada ..... 463/25
2008/0132314 A1 * 6/2008 Robb et al. ..... 463/17
2009/0098921 A1 * 4/2009 Manning et al. ..... 463/17
2009/0104963 A1 * 4/2009 Burman et al. ..... 463/18
2009/0247278 A1 * 10/2009 Yoshizawa ..... 463/22
2010/0148442 A1 * 6/2010 Walker et al. ..... 273/274

* cited by examiner

*Primary Examiner* — Paul A D'Agostino

(74) *Attorney, Agent, or Firm* — Lexyoume IP Meister, PLLC

(57) ABSTRACT

A gaming machine executes a game in which a player makes a bet in a desired bet pattern having combined a plurality of bet elements; stores the bet pattern used for the game; and allows the player to select one of the bet element and the bet pattern. When the bet element is selected, a bet is made by the bet pattern using the bet element selected. When the bet pattern is selected, a bet is made by the bet pattern selected.

14 Claims, 16 Drawing Sheets memory BET
manual BET
registering process
game time is over
payout process
BET
cancel
pattern1
pattern2
pattern3

FIG. 7

Payout management table

| No. | bet type | payout rate |
|---|---|---|
| 1 | Straight | 35:1 |
| 2 | Split | 17:1 |
| 3 | Street | 11:1 |
| 4 | Corner | 8:1 |
| 5 | Five | 6:1 |
| 6 | Line | 5:1 |
| 7 | Column | 2:1 |
| 8 | Dozen | 2:1 |
| 9 | Red or Black | 1:1 |
| 10 | Odd or Even | 1:1 |
| 11 | Low or High | 1:1 |

FIG. 8 station management table

| station | bet information | | bonus participator |
|---|---|---|---|
| | bet type | bet-number | |
| 1 | Straight・Corner | 20 | 1 |
| 2 | Red | 15 | 1 |
| 3 | Straight・Corner | 2 | 0 |
| 4 | ・・・ | 24 | 1 |
| 5 | ・・・ | 5 | 0 |
| 6 | ・・・ | 35 | 1 |
| 7 | ・・・ | 2 | 0 |
| 8 | ・・・ | ・・・ | ・・・ |
| 9 | ・・・ | ・・・ | ・・・ |
| 10 | | | |
| 11 | | | |
| 12 | ・・・・ | ・・・ | ・・・ |

FIG. 9 bet pattern table

| pattern number | bet information | |
|---|---|---|
| | bet type | bet-number |
| 1 | Straight・Corner | 20 |
| | Red | 15 |
| | ・・・ | 2 |
| | ・・・ | 24 |
| | ・・・ | 5 |
| 2 | ・・・ | 35 |
| | ・・・ | 2 |
| | ・・・ | ・・・ |
| 3 | ・・・ | ・・・ |
| | ・・・ | ・・・ |
| | ・・・ | ・・・ |
| | ・・・・ | ・・・ |

GAMING MACHINE REPRODUCING BET PATTERN AND PLAYING METHOD THEREOF

CROSS REFERENCE TO RELATED APPLICATION

The present application claims priority from provisional application No. 60/985,455, which was filed on Nov. 5, 2007, the entire disclosure of which is herein incorporated by reference.

BACKGROUND OF THE INVENTION

1. Field of the Invention

The invention relates to a gaming machine performing a game in which a bet can be made in a bet pattern having combined a plurality of bet elements, and a playing method thereof.

2. Description of Related Art

A gaming machine is known in which a player combines a plurality of bet elements such as bet-number or bet-type, thereby performing a bet in a bet pattern that the player desires. To be more specific, U.S. Pat. Nos. 6,663,106 and 5,934,999 disclose a roulette apparatus comprising a disc-shaped wheel having a plurality of numbered ball recesses arranged in a line at a periphery of the wheel and a roulette table having bet areas corresponding to the numbers of the wheel. According to the roulette apparatus, a player can repeat an operation in which the player selects a bet-type such as straight bet and a bet-number, thereby performing a roulette game by a bet of a desired bet pattern having combined the bet-type and the bet-number.

An object of the invention is to provide a gaming machine enabling a player to bet in a bet pattern, which the player desires, without selecting a bet-type and a bet-number.

SUMMARY OF THE INVENTION

The invention provides a gaming machine comprising: a game in which a player can make a bet in a desired bet pattern having combined a plurality of bet elements (bet-number, bet-type and the like); a bet element receiving apparatus (for example, a touch panel transmissively displaying bet areas) that individually receives the bet elements of the bet pattern; a bet pattern receiving apparatus (for example, a touch panel transmissively displaying icons) that receives the bet pattern; a memory device that stores the bet pattern; and a controller programmed to operate as described in steps of (a1)~(a4).

Specifically, the controller operates:

(a1) to store the bet pattern used for the game in the memory device so as to correspond to the bet pattern receiving apparatus;

(a2) to enable the player to select one of the bet element receiving apparatus and the bet pattern receiving apparatus;

(a3) when the bet element receiving apparatus is selected, to make a bet by the bet pattern using the bet element received by the bet element receiving apparatus; and (a4) when the bet pattern receiving apparatus is selected, to make a bet by the bet pattern of the memory device, which is made to correspond to the bet pattern receiving apparatus.

According to the above structure, when the bet element receiving apparatus is selected, the bet element received by the bet element receiving apparatus is used, so that a player can make a desired bet pattern and make a bet. In the mean time, when the bet pattern receiving apparatus is selected, a bet can be made with the bet pattern corresponding to the bet pattern receiving apparatus being used as a desired bet pattern. Thereby, when an operation of selecting the bet pattern receiving apparatus is just carried out, a bet can be made using a desired bet pattern having combined the bet elements, so that an operation time for which the player makes a bet can be reduced.

The invention provides a gaming machine comprising: a game in which a player can make a bet in a desired bet pattern having combined a plurality of bet elements (bet-number, bet-type and the like); a bet element receiving apparatus that individually receives the bet elements of the bet pattern; a bet pattern receiving apparatus that receives the bet pattern; a memory device that stores the bet pattern; a bet pattern indicating apparatus that allows the player to indicate the bet pattern; and a controller programmed to operate as described in steps of (b1)~(b4).

Specifically, the controller operates:

(b1) to store in the memory device the bet pattern indicated by the bet pattern indicating apparatus so as to correspond to the bet pattern receiving apparatus;

(b2) to enable the player to select one of the bet element receiving apparatus and the bet pattern receiving apparatus;

(b3) when the bet element receiving apparatus is selected, to make a bet by the bet pattern using the bet element received by the bet element receiving apparatus; and (b4) when the bet pattern receiving apparatus is selected, to make a bet by the bet pattern of the memory device, which is made to correspond to the bet pattern receiving apparatus.

According to the above structure, when the bet element receiving apparatus is selected, the bet element received by the bet element receiving apparatus is used, so that a player can make a desired bet pattern and make a bet. In the mean time, when the bet pattern receiving apparatus is selected, a bet can be made with the bet pattern corresponding to the bet pattern receiving apparatus being used as a desired bet pattern. Thereby, when an operation of selecting the bet pattern receiving apparatus is just carried out, a bet can be made using a desired bet pattern having combined the bet elements, so that an operation time for which the player makes a bet can be reduced.

Furthermore, when the player desires, in a next game, to re-use the bet pattern during the game, the bet pattern is indicated by the bet pattern indicating apparatus, so that the bet pattern desired by the player can be positively made to correspond to the bet pattern receiving apparatus.

The invention provides a gaming machine comprising: a game in which a player can make a bet in a desired bet pattern having combined a plurality of bet elements; a bet element receiving apparatus that individually receives the bet elements of the bet pattern; a plurality of bet pattern receiving apparatuses that receive the bet pattern; a memory device that stores the bet pattern; and a controller programmed to operate as described in steps of (c1)~(c4).

Specifically, the controller operates:

(c1) to store each bet pattern used for the game in the memory device so as to correspond to one of the bet pattern receiving apparatuses;

(c2) to enable the player to select one of the bet element receiving apparatus and the bet pattern receiving apparatuses;

(c3) when the bet element receiving apparatus is selected, to make a bet by the bet pattern using the bet element received by the bet element receiving apparatus; and (c4) when one of the bet pattern receiving apparatuses is selected, to make a bet by the bet pattern of the memory device, which is made to correspond to the bet pattern receiving apparatus selected.

According to the above structure, when the bet element receiving apparatus is selected, the bet element received by the bet element receiving apparatus is used, so that a player can make a desired bet pattern and make a bet. In the mean time, when the bet pattern receiving apparatus is selected, a bet can be made with the bet pattern corresponding to the bet pattern receiving apparatus being used as a desired bet pattern. Thereby, when an operation of selecting the bet pattern receiving apparatus is just carried out, a bet can be made using a desired bet pattern having combined the bet elements, so that an operation time for which the player makes a bet can be reduced.

Furthermore, since the bet patterns can be made to correspond to the bet pattern receiving apparatuses, respectively, it is possible to make a bet with the bet patterns just by performing the operation of selecting the respective bet pattern receiving apparatuses. As a result, the operation time for which the player makes a bet can be further reduced.

The invention provides a gaming machine comprising: a game in which a player can make a bet in a desired bet pattern having combined a plurality of bet elements; a bet element receiving apparatus that individually receives the bet elements of the bet pattern; a plurality of bet pattern receiving apparatuses that receive the bet pattern; a plurality of bet pattern indicating apparatuses that allow the player to indicate the bet pattern; a memory device that stores the bet pattern; and a controller programmed to operate as described in steps of (d1)~(d4).

Specifically, the controller operates:

(d1) to store in the memory device the bet pattern indicated by any one of the bet pattern indicating apparatuses so as to correspond to one of the bet pattern receiving apparatuses;

(d2) to enable the player to select one of the bet element receiving apparatus and the respective bet pattern receiving apparatuses;

(d3) when the bet element receiving apparatus is selected, to make a bet by the bet pattern using the bet element received by the bet element receiving apparatus; and (d4) when one of the bet pattern receiving apparatuses is selected, to make a bet by the bet pattern of the memory device, which is made to correspond to the bet pattern receiving apparatus selected.

According to the above structure, when the bet element receiving apparatus is selected, the bet element received by the bet element receiving apparatus is used, so that a player can make a desired bet pattern and make a bet. In the mean time, when the bet pattern receiving apparatus is selected, a bet can be made with the bet pattern corresponding to the bet pattern receiving apparatus being used as a desired bet pattern. Thereby, when an operation of selecting the bet pattern receiving apparatus is just carried out, a bet can be made using a desired bet pattern having combined the bet elements, so that an operation time for which the player makes a bet can be reduced.

Furthermore, since the bet patterns can be made to correspond to the bet pattern receiving apparatuses, respectively, it is possible to make a bet with the bet patterns just by performing the operation of selecting the respective bet pattern receiving apparatuses. As a result, the operation time for which the player makes a bet can be further reduced.

Furthermore, when the player desires, in a next game, to re-use the bet pattern during the game, the bet pattern is indicated by the bet pattern indicating apparatus, so that the bet pattern desired by the player can be positively made to correspond to the bet pattern receiving apparatus.

In the invention, the game is a multiplayer-type game that allows participation of two or more players. Furthermore, in the invention, the game is one of a roulette game, a horse race game, a motorboat race game and a bicycle race game.

The invention provides a playing method comprising the steps of: allowing a player to make a bet in a bet pattern having combined a plurality of bet elements, thereby performing a game; storing the bet pattern used for the game; allowing the player to select one of the bet element and the bet pattern; when the bet element is selected, making a bet by the bet pattern using the bet element selected; and when the bet pattern is selected, making a bet by the bet pattern selected.

According to the above structure, the bet element selected is used, so that the player can make a desired bet pattern and make a bet. In the mean time, when the bet pattern is selected, a bet can be made with the bet pattern being used as a desired bet pattern. Thereby, when an operation of selecting the bet pattern is just carried out, a bet can be made using a desired bet pattern having combined the bet elements, so that an operation time for which the player makes a bet can be reduced.

BRIEF DESCRIPTION OF THE DRAWINGS

FIG. 7 illustrates a payout management table;

FIG. 8 illustrates a station management table;

FIG. 9 illustrates a bet pattern table;

DESCRIPTION OF THE PREFERRED EMBODIMENTS

Hereinafter, an embodiment of the invention will be described with reference to FIGS. 1 to 16.

A gaming machine is structured so that it executes a game in which a player can reproduce a desired bet pattern having combined a plurality of bet elements to make a bet. In other words, the gaming machine comprises a game in which a player can make a bet in a desired bet pattern having combined a plurality of bet elements; a bet element receiving apparatus that individually receives the bet elements of the bet pattern; a bet pattern receiving apparatus that receives the bet pattern; a memory device that stores the bet pattern; and a controller programmed to operate as described in following steps of (a1)~(a4).

Figure 1:
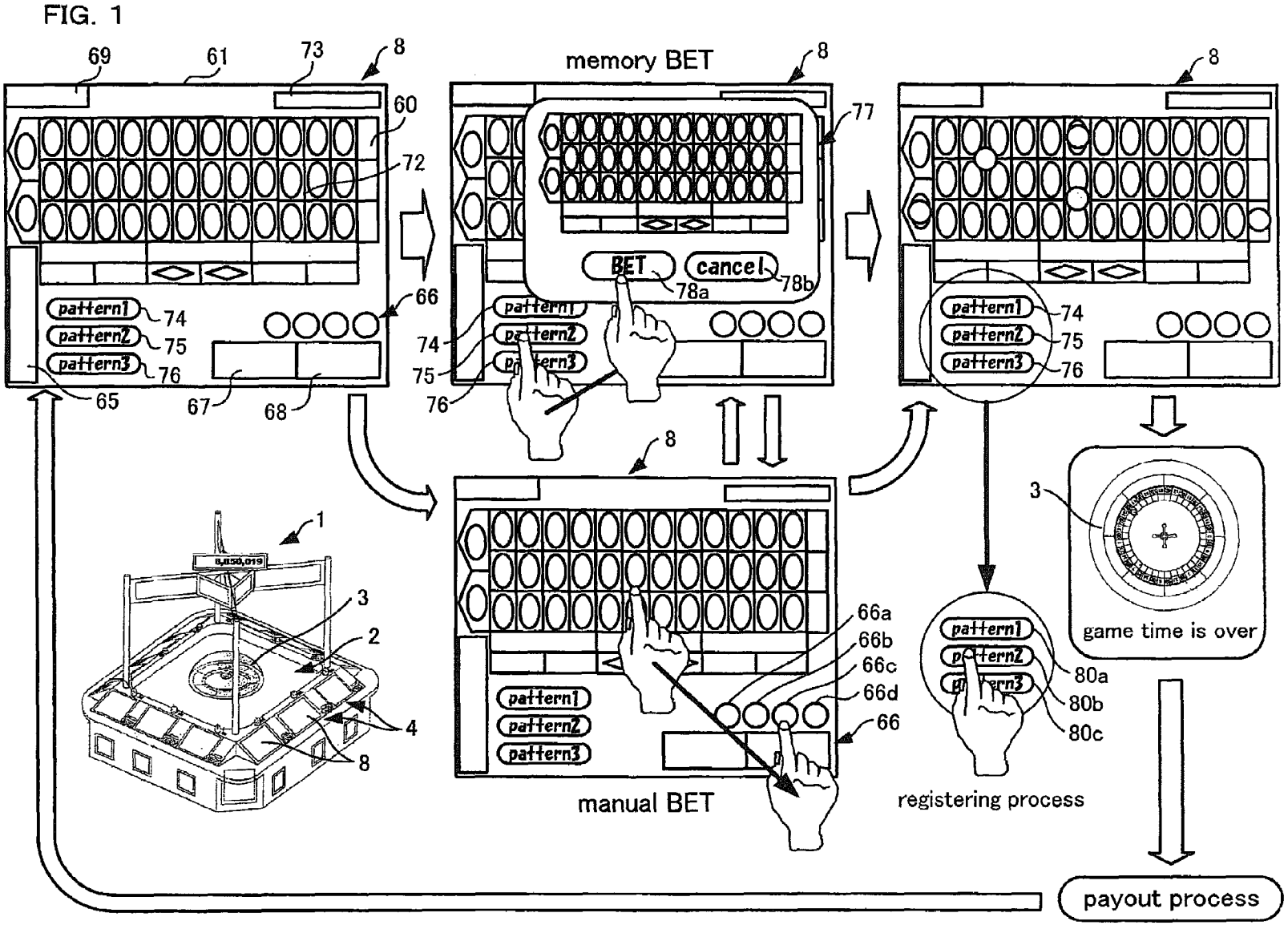
FIG. 1 illustrates an operating state of a roulette gaming machine.
Figure 2:
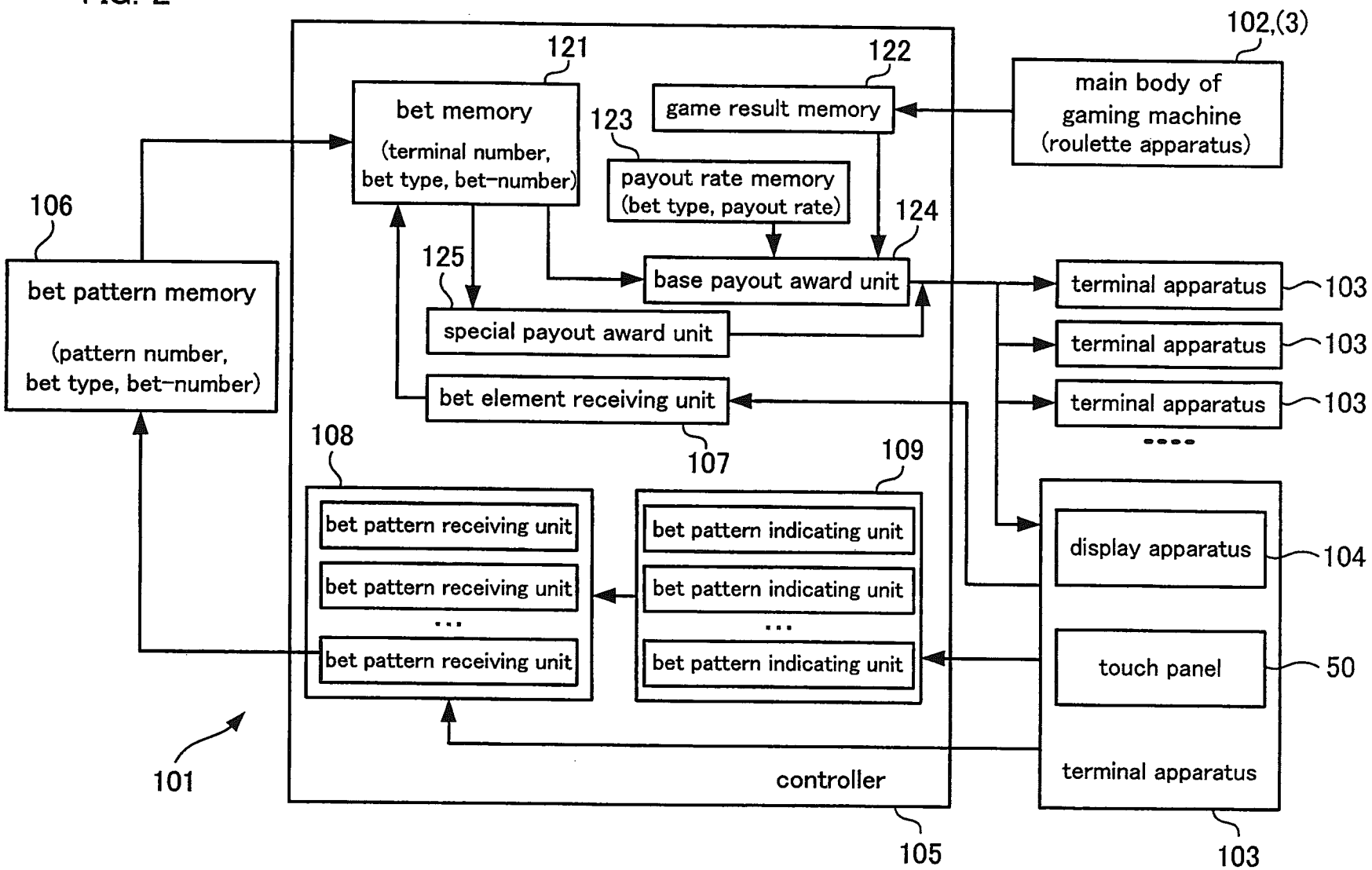
FIG. 2 is a block diagram of a roulette gaming machine.

To be more specific, as shown in FIGS. 1 and 2, the gaming machine 101 comprises a main body 102 (roulette apparatus 3) of the gaming machine that executes the above game; a plurality of terminal apparatuses 103 that receives a bet to be used for the game and awards a payout; a display apparatus 104 that displays image data relating to the game; and a bet pattern memory device 106 of FIG. 2 that stores a bet pattern. Each of the terminal apparatuses 103 has a bet element receiving apparatus 107 that individually receives the bet elements of the bet pattern, and bet pattern receiving units 108 that receive the bet pattern.

The controller 105 is configured to execute a program that operates as described in the following steps of (a1)~(a5). In the step of (a1), the controller 105 stores in the bet pattern memory device 106 the bet pattern used for a game so as to correspond to the bet pattern receiving unit 108. In the step of (a2), the controller 105 enables a player to select one of the bet element receiving apparatus 107 and the bet pattern receiving unit 108. In the step of (a3), when the bet element receiving apparatus 107 is selected, the controller 105 makes a bet by the bet pattern using the bet element received by the bet element receiving apparatus 107. In the step of (a4), when the bet pattern receiving unit 108 is selected, the controller 105 makes a bet by the bet pattern of the bet pattern memory device 106, which is made to correspond to the bet pattern receiving unit 108.

Thereby, when the bet element receiving apparatus 107 is selected, the bet element received by the bet element receiving apparatus 107 is used, so that a player can make a desired bet pattern and make a bet. In the mean time, when the bet pattern receiving unit 108 is selected, a bet can be made with the bet pattern corresponding to the bet pattern receiving unit 108 being used as a desired bet pattern. As a result, when an operation of selecting the bet pattern receiving unit 108 is just carried out, a bet can be made using a desired bet pattern having combined the bet elements, so that an operation time for which the player makes a bet can be reduced.

In addition, the controller 105 executes the step of awarding a base payout to each of the terminal apparatuses 103 based on an execution result of the game and a game value bet, and the step of determining whether or not to set each of the terminal apparatuses 103 as a participation object for a special payout, based on the bets in each of the terminal apparatuses 103, randomly selecting a special payout object among the participation objects and awarding a special payout in the terminal apparatus 103 that is the special payout object.

Here, the "gaming machine 101" may be a one player-type or a multiplayer-type. The examples of the multiplayer-type may include a gaming machine (for example, roulette gaming machine 1) that executes a roulette game, a horse race game, a motorboat race game, a bicycle race game and the like, on condition that many players take part in the game. Furthermore, the gaming machines such as slot machine in which one player executes a game are connected to each other in data communication manner, thereby constituting a multiplayer player-type gaming machine.

The "bet element" means a minimum unit for making a bet. To be more specific, for a roulette game, a bet aspect such as straight bet or split bet, a bet-number for each bet aspect and the like are the bet element. The "bet pattern" is an aspect having combined a plurality of bet elements. In the mean time, the bet pattern may be a single bet element.

The "main body 102 of the gaming machine" may be any one of a game to be executed by a mechanical operation, a game to be executed by an electrical operation and a game to be executed by a combination of mechanical and electrical operations, as long as it executes a multiplayer-type game. The game to be executed by a mechanical operation may include a game using a roulette apparatus 3 that rotates or moves a ball or wheel that is actually made. The game to be executed by an electrical operation may include a game that displays an image of a ball or wheel on a display apparatus such as liquid crystal display, thereby virtually rotating or moving it.

The "terminal apparatus 103" may be a game-indicated terminal apparatus (station 4) or an information processing apparatus such as universal personal computer, as long as it can receive a bet to be used for a game and award a payout. The "image data" may be still image data or moving image data. In addition, the contents of the image data are the number of the terminal apparatus 103, a bet area and the like. The "display apparatus 104" may be provided in each of the respective terminal apparatuses 103 or may be a large screen display common to all the terminal apparatuses 103. For example, the display apparatus 104 may include a liquid crystal display apparatus, a CRT (Cathode-Ray Tube) apparatus, a plasma display apparatus and the like.

The "bet pattern memory device 106" may be a variety of memory devices such as hard disk device or memory, as long as it stores the bet pattern. In addition, the bet pattern memory device 106 may be provide in each of the terminal devices 103 or may be commonly used to the terminal devices 103. The "bet element receiving apparatus 107" and the "bet pattern receiving unit 108" may be a touch panel that is provided to a screen of the display apparatus 104, or may be a button that is separately provided from the display apparatus 104.

The "execution result of a game" is a state in which a winning can be made by execution of a unit game. In this embodiment, the "execution result of a game" may be also referred to as a "game result." For example, in case of a roulette game in which a ball is rolled on a wheel, a mark attached to the wheel, which corresponds to a stop position of the ball, is an execution result. In case of a slot game, a stop aspect of symbols rearranged is an execution result. In the mean time, the "rearrangement" means arranging the symbols again after dismissing the arrangement of the symbols. The "arrangement" means a state in which the symbols are allowed to be visible with naked eyes of an exterior player.

The "unit game" is a series of operations from a reception state of a bet (bet time) to a state in which a winning can be made (game time, payout time). For example, in case of a roulette game, the unit game includes a bet time at which a bet is received, a game time for which a ball is rolled and then stopped and a payout time of a payout process in which a payout is awarded.

The "game value" includes a medal, a coin, a gaming ball, money, bill, a magnetic card and the like. The "base payout" is a payout that is awarded based on an execution result of a game and a game value bet. For example, in case of a roulette game, the game value is a payout that is determined on the basis of a payout rate, which is set in a bet area corresponding to a mark (prize winning mark) corresponding to a stop position of a ball after rolling the ball in a roulette apparatus, and a game value, which is a bet-number bet on the bet area.

The "special payout" means a bonus that is paid out irrespective of the game value bet. A jackpot may be set as a special payout. In the mean time, the "jackpot" means that some of the game values bet are subtracted and accumulated and all or a part of the game values accumulated is awarded when a winning is made.

The "participation object" means a terminal apparatus 103 having obtained a lottery right to the special payout. The lottery right is a right that is determined by means of a random selection. The participation object is set based on a bet. A setting type based on a bet may be a type based on a degree of a game value bet or a type in which a bet is made on a side bet area equipped for a participation object. The "special payout object" means a terminal apparatus 103 to which a special payout selected among the participation objects is awarded.

The gaming machine 101 structured as described above performs a playing method comprising the steps of executing a game by making a bet in a desired bet pattern having combined a plurality of bet elements by a player; storing (registering) the bet pattern used for the game; allowing the player to select any one of the bet element and the bet pattern; when the bet element is selected, making a bet (manual bet) by the bet pattern using the bet elements selected; and when the bet pattern is selected, making a bet (memory bet) by the bet pattern selected.

Thereby, the bet element selected is used, so that the gaming machine 101 can make a bet pattern that the player desires and make a bet. In the mean time, the bet pattern is selected, so that a bet can be made with the bet pattern being used as a desired bet pattern. As a result, when an operation of selecting the bet pattern is just carried out, a bet can be made using a desired bet pattern having combined the bet elements, so that an operation time for which the player makes a bet can be reduced.

In addition, the gaming machine 101 is structured to execute a game in which a bet pattern registered by a player can be reproduced to make a bet. In other words, as shown in FIG. 1, the gaming machine 101 further comprises a bet pattern indicating unit 109 allowing a player to indicate a bet pattern and a controller 105 that is programmed to operate as described in the steps of (b1)~(b4).

In the step of (b1), the controller 105 stores the bet pattern indicated by the bet pattern indicating unit 109 in the bet pattern memory device 106 so as to correspond to the bet pattern receiving unit 108. In the step of (b2), the controller 105 allows a player to select any one of the bet element receiving apparatus 107 and the bet pattern receiving unit 108. In the step of (b3), when the bet element receiving apparatus 107 is selected, the controller 105 makes a bet by a bet pattern using the bet element received by the bet element receiving apparatus 107. In the step of (b4), when the bet pattern receiving unit 108 is selected, the controller 105 makes a bet by the bet pattern of the bet pattern memory device 106, which is made to correspond to the bet pattern receiving unit 108.

Thereby, when the player desires, in a next game, to re-use the bet pattern during the game, the gaming machine 101 indicates the desired bet pattern by the bet pattern indicating apparatus, so that the bet pattern desired by the player can be positively made to correspond to the bet pattern receiving apparatus by the player's intension.

In addition, the gaming machine 101 is structured to execute a game in which one of the bet patterns is reproduced by the player's selection to make a bet. In other words, as shown in FIG. 1, the gaming machine 1 comprises a plurality of bet pattern receiving units 108 that receive bet patterns and a controller 105 that is programmed to operate as described in the steps of (c1)~(c4).

In the step of (c1), the controller 105 stores each bet pattern used for a game in the bet pattern memory device 106 so as to correspond to one of the bet pattern receiving units 108. In the step of (c2), the controller 105 enables a player to select one of the bet element receiving apparatus 107 and the respective bet pattern receiving units 108. In the step of (c3), when the bet element receiving apparatus 107 is selected, the controller 105 makes a bet by the bet pattern using the bet element received by the bet element receiving apparatus 107. In the step of (c4), when one of the respective bet pattern receiving units 108 is selected, the controller 105 makes a bet by the bet pattern of the bet pattern memory device 106, which is made to correspond to the bet pattern receiving unit 108 selected.

Thereby, since the bet patterns can be made to correspond to the respective bet pattern receiving units 108, when an operation of selecting the bet pattern receiving unit 108 is just carried out, the gaming machine 10 can make a bet of the bet patterns. As a result, an operation time for which the player makes a bet can be further reduced.

In addition, the gaming machine 101 is structured to execute a game in which one of the bet patterns is reproduced by the player's selection to make a bet. In other words, as shown in FIG. 1, the gaming machine 1 comprises a plurality of bet pattern receiving units 108 that receive bet patterns, a plurality of bet pattern indicating units 109 that allow a player to indicate a bet pattern and a controller 105 that is programmed to operate as described in the steps of (d1)~(d4).

In the step of (d1), the controller 105 stores in the bet pattern memory device 106 the bet pattern indicated by any one of the respective bet pattern indicating units 109 so as to correspond to one of the bet pattern receiving units 108. In the step of (d2), the controller enables a player to select one of the bet element receiving apparatus 107 and the respective bet pattern receiving units 108. In the step of (d3), when the bet element receiving apparatus 107 is selected, the controller 105 makes a bet by the bet pattern using the bet element received by the bet element receiving apparatus 107. In the step of (d4), when one of the respective bet pattern receiving units 108 is selected, the controller 105 makes a bet by the bet pattern of the bet pattern memory device 106, which is made to correspond to the bet pattern receiving unit 108 selected.

Thereby, since the bet patterns can be made to correspond to the respective bet pattern receiving units 108, when an operation of selecting the bet pattern receiving unit 108 is just carried out, the gaming machine 10 can make a bet of the bet patterns. As a result, an operation time for which the player makes a bet can be further reduced. Furthermore, during the game, when the player desires to re-use the bet pattern in a next game, the gaming machine indicates the bet pattern by the bet pattern indicating u unit 109, so that the bet pattern desired by the player can be positively made to correspond to the bet pattern receiving unit 108.

(Structure of the Controller 105)

As shown in FIG. 2, the gaming machine 101 comprises a roulette apparatus 3 (main body 102 of the gaming machine) executing a roulette game in which a ball is rolled on a wheel having a plurality of marks arranged thereon; a plurality of terminal apparatuses 103 each of which has a plurality of bet areas corresponding to at least one mark, receives a bet on the bet areas and awards a payout; display apparatuses 104 each of which is provided to each of the terminal apparatuses 103 and displays image data and bet areas relating to a roulette game; touch panels 50 each of which is provided to a front side of each display apparatus 104 to be pushed from an outside and is transmissive; and a controller 105.

The controller 105 comprises a bet element receiving unit 107, bet pattern receiving units 108, bet pattern indicating units 109, a bet memory 121, a game result memory 122, a payout rate memory 123, a base payout award unit 124 and a special payout award unit 125.

The bet element receiving unit 107 is connected to the touch panel 50 of the terminal apparatus 103. The bet element receiving unit 107 receives an operation signal from the touch panel 50 and recognizes, as a bet element, contents of display of the display apparatus 104, which are made to correspond to operation position coordinates included in the operation signal. In addition, the bet element receiving unit 107 has a function of outputting and storing a bet element in the bet memory 121.

In addition, the bet pattern indicating unit 109 is provided one or more. Each of the bet pattern indicating units 109 is connected to the touch panel 50 of the terminal apparatus 103. The bet pattern indicating unit 109 receives an operation signal from the touch panel 50, sets, as a bet pattern indicating part, a display area of the display apparatus 104, which is made to correspond to operation position coordinates included in the operation signal, and outputs to the bet pattern receiving unit 108 a data signal including a display area of the bet pattern indicating part.

The bet pattern receiving unit 108 is provided one or more and made to correspond to each of the bet pattern indicating units 109. Each of the bet pattern receiving units 108 is given with an inherent pattern number. The bet pattern receiving unit 108 recognizes, as a bet pattern, a combination of the bet elements of the display apparatuses 104 at a timing at which it receives the data signal from the bet pattern indicating unit 109. In addition, the bet pattern receiving unit 108 stores the recognized bet pattern in the bet pattern memory device 106. Furthermore, the bet pattern indicating unit 109 transmits and stores the bet pattern, which is made to correspond to the bet pattern receiving unit 108 specified by a bet command from the terminal apparatus 103, from the bet pattern memory device 106 into the bet memory 121.

The bet memory 121 stores the bet pattern from the bet pattern memory 106 and the bet elements from the bet element receiving unit 107. Meantime, after the bet pattern is transmitted, it may be possible that the bet pattern is added with a bet element from the bet element receiving unit 107 or a predetermined bet element is deleted or changed from the bet pattern. The bet memory 121 is connected to the base payout award unit 124 and the special payout award unit 125. The base payout award unit 124 has functions of selecting or specifying a participation object of a special award among the terminal apparatuses 103, randomly selecting a special payout object among the terminal apparatuses 103 of the participation objects and awarding a special payout to the terminal apparatus 103 of the special payout object.

In the mean time, the base payout award unit 124 is connected to the game result memory 122 and the payout rate memory 123. The game result memory 122 stores a game result of the main body 102 of the gaming machine. To be more specific, the base payout award unit 124 has functions of receiving a signal from the roulette apparatus 3 that is the main body 102 of the gaming machine and setting, as a prize winning mark, a mark corresponding to a stop position after the ball is rolled on the roulette apparatus 3. In addition, the payout rate memory 123 stores a bet type and a payout rate.

The base payout award unit 124 has a function of receiving a bet pattern from the bet memory 113, a prize winning mark from the game result memory 122 and a bet type and a payout rate from the payout rate memory 123. Furthermore, the base payout award unit 124 has functions of calculating a base payout based on a payout rate set in a bet area corresponding to a prize winning mark and a bet-number (game value) bet on the bet area and awarding a base payout to the terminal apparatus 103 corresponding to a terminal number.

In the mean time, the controller 105 has functions of calculating a total sum of the bet-numbers bet for the respective terminal apparatuses 103, storing the total sum correspondingly to the terminal number of the terminal apparatus 103, determining whether the total sum is a predetermined value or more and setting, as a participation object, a terminal number that is determined to have a total sum of the predetermined value or more.

Each block of the controller 105 may be embodied in hardware or software, as required.

(Operation of the Controller 105)

In the followings, an operation of the controller 105 will be described.

Firstly, an operation is carried out at a bet timing. The image data and bet areas relating to a roulette game are displayed on the display apparatus 104 of the terminal apparatus 103. Then, when the touch panel 50 is pushed, the bet element receiving unit 107 or bet pattern receiving unit 108 corresponding to the pushed location is operated. When the bet element receiving unit 107 is operated, a terminal signal including the bet element data such as bet type or bet-number (game value) is received to the bet element receiving unit 107, in addition to the terminal data such as terminal number of the terminal apparatus 103. Then, the bet element is stored in the bet memory 121. In the mean time, the stored state of the bet element is displayed on the display apparatus 104 of the terminal apparatus 103 having the terminal number for which the push operation has been performed.

In the mean time, when the bet pattern receiving unit 108 is operated, a bet pattern made to correspond to the bet pattern receiving unit 108 under operation is read out from the bet pattern memory device 106 and then transmitted to the bet memory 121. Meanwhile, the stored state of the bet pattern is displayed on the display apparatus 104 of the terminal apparatus 103 having the terminal number for which the push operation has been performed.

Then, an operation in a game time from the bet timing is started. In the roulette apparatus 3, a roulette game is started. In other words, a ball is rolled on a wheel having a plurality of marks arranged thereon. Then, when the ball is stopped and the roulette game is thus over, a mark corresponding to a stop position of the ball is obtained. The mark is outputted to the game result memory 122. When the game result memory 122 receives the mark outputted from the roulette apparatus 3, it sets the received mark as a prize winning mark. Thereby, the game time is over. In the mean time, the bet time is over before the game time is over.

When the game time is over, an operation in a payout time is started. The prize winning mark is outputted to the base payout award unit 124. When the prize winning mark is inputted to the base payout award unit 124, the base payout award unit 124 obtains terminal data from the bet memory 121 and a bet type and a payout rate from the payout rate memory 123. Then, a base payout is calculated based on the bet pattern stored in the bet memory 121. Then, a base payout is awarded in the terminal apparatus 103 corresponding to the terminal number.

(Mechanical Structure: Schematic Structure)

Figure 3:
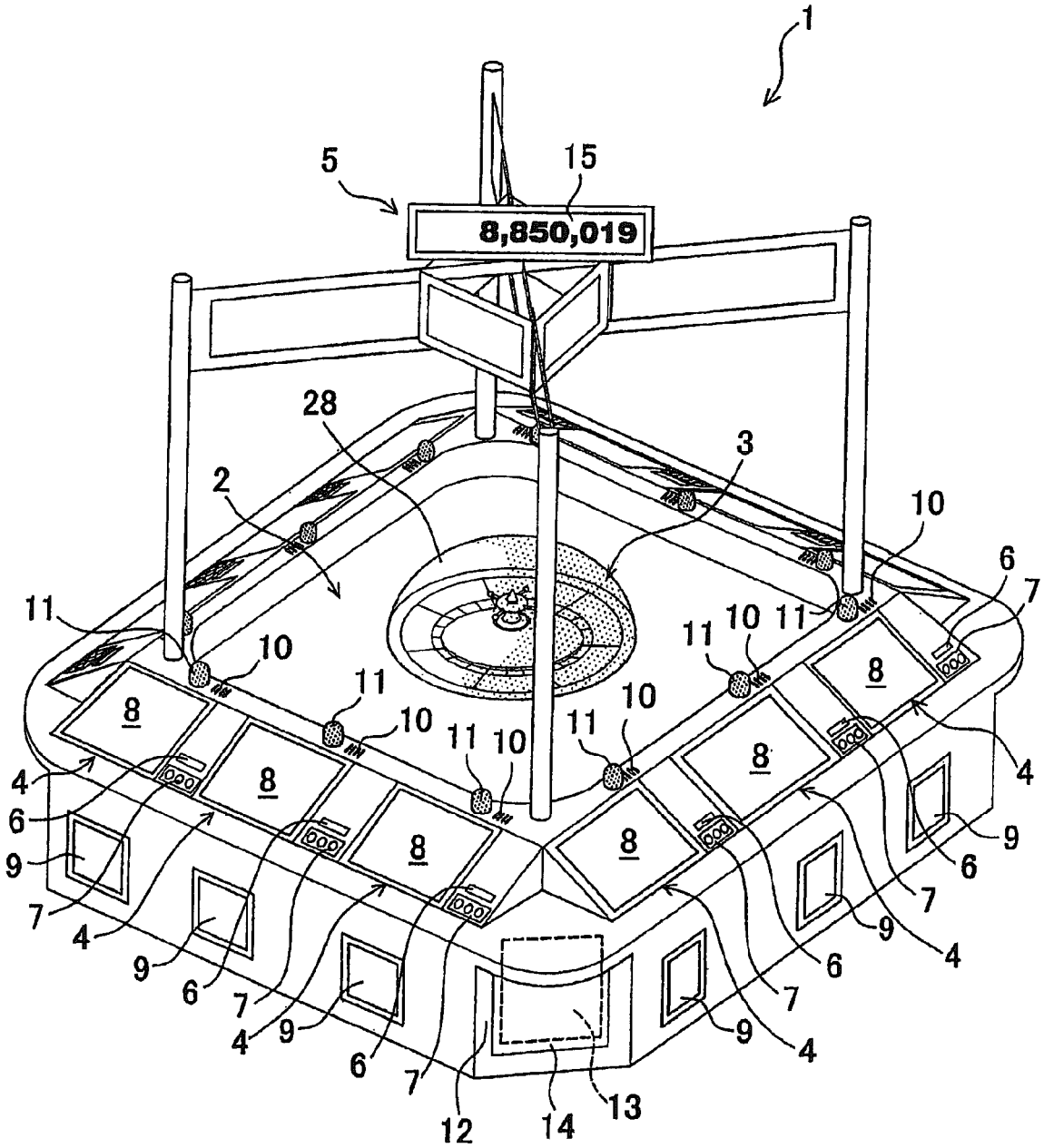
FIG. 3 is an external perspective showing a schematic structure of a roulette gaming machine.

In the followings, it will be specifically described a case where the gaming machine 101 is applied to a roulette gaming machine 1. FIG. 3 is an external perspective view showing a schematic structure of a roulette gaming machine 1 according to an embodiment. The roulette gaming machine 1 has a cabinet 2, a roulette apparatus 3, stations 4 and an electric light display unit 5. The cabinet 2 fixes the roulette apparatus 2, the stations 4 and the electric light display unit 5 at predetermined positions and protects a device equipped therein such as electronic substrate.

The roulette apparatus 3 corresponds to the main body 102 of the gaming machine shown in FIG. 2 and is disposed about at a central part of the cabinet 2. The stations 4 correspond to the terminal apparatuses 103 of FIG. 2 and are disposed around the roulette apparatus 2. To be more specific, the 12 stations 4 are disposed to surround the roulette apparatus 3. The station 4 serves as a bet unit for receiving a bet operation of a player and a payout unit for awarding a medal. The bet operation is an operation that a player expecting a winning number of the roulette apparatus 3 inputs the contents such as number corresponding to the expected winning number.

The electric light display unit 5 has a JP amount indicator 15. The JP amount indicator 15 is mounted on a top of the electric light display unit 5. Thereby, the JP amount indicator 15 allows all players who play a game in the stations 4 to see the contents of display with naked eyes.

The JP amount indicator 15 displays a jackpot (JP) amount that is a special payout. Here, the roulette gaming machine 1 accumulates 0.5% of credits that are bet in a roulette game using a BET screen in the twelve stations 4 and stores the accumulated credit as a jackpot. The credit of the jackpot is paid out to a predetermined station 4 when a special payout is made. Meanwhile, the "prize winning" means that a winning is made.

In addition, the roulette gaming machine 1 has a server 13. The server 13 corresponds to the controller 105 of FIG. 2. The server 13 is disposed at a corner part 12 of the cabinet 2. The server 13 is received in an inner space of the corner part 12. The inner space of the corner part 12 can be opened/shut by means of a corner door 14 having an authentication key attached. The corner door 14 is typically shut so that a player cannot operate the server 13. In the mean time, in the operation of the server 13, the corner door 14 is opened by operating an authentication key. Thereby, the server 13 is operated from an outside of the cabinet 2, so that the roulette gaming machine 1 can be variously set.

(Mechanical Structure: Roulette Apparatus 3)

Figure 4:
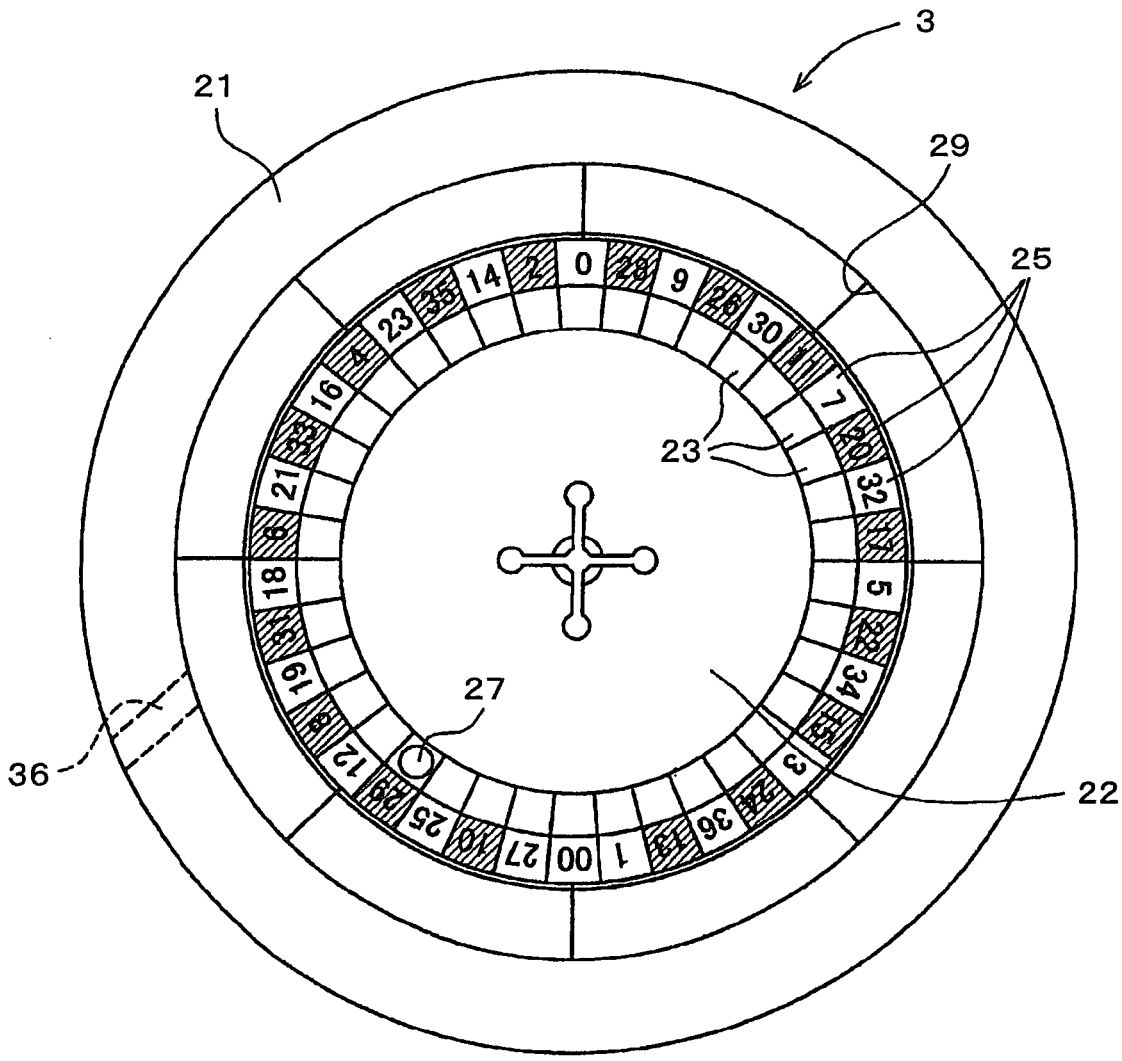
FIG. 4 is a plan view of a roulette wheel.

A structure of the roulette apparatus 3 will be described with reference to FIG. 4. FIG. 4 is a plan view of the roulette apparatus 3 according to an embodiment. The roulette apparatus 3 comprises a frame 21 fixed to the cabinet 2 and a wheel 22 disposed at an inner side of the frame 21. As shown in FIG. 3, an entire upper part of the roulette apparatus 3 is covered by means of a hemisphere cover member 28 made of transparent acryl.

As shown in FIG. 4, the wheel 22 is received in the frame 21 and its upper surface is exposed to an outside. The wheel 22 is horizontally disposed so that a center axis of rotation thereof is identical to a vertical direction, and is supported to freely rotate so that a center point thereof is a rotation center. The wheel 22 has a plurality of numbered pockets 23 (38 pockets in this embodiment). The numbered pockets 23 are disposed in a ring shape at a periphery of an upper surface of the wheel 22. Each of the numbered pockets 23 is shaped in a recess shape having a size and a depth capable of receiving a ball 27.

Further, the wheel 22 has a plurality of numbered plates 25. The numbered plates 25 are set same as the numbered pockets 23. The numbered plates 25 indicate each number of "00", "0", "1"~"36" as figure letters. Each of the numbered plates 25 is disposed at the periphery of the respective numbered pockets 23. Thereby, the numbered pockets 23 are given with any number of "00", "0", "1"~"36" of the numbered plates 25.

The frame 21 that the wheel 22 is disposed at the center of the frame is inclined downward at a small degree from the periphery to the wheel 22. The frame 21 has a guide wall 29. The guide wall 29 is disposed between the periphery of the frame 21 and the wheel 22. The guide wall 20 guides an inserted ball 27 against centrifugal force, thereby allowing the ball 28 to roll.

In addition, the frame 21 has a ball insertion slot 36. The ball insertion slot 36 is opened to the wheel 22. The ball insertion slot 36 is connected to a ball insertion apparatus (not shown) that is equipped in the frame 21. The ball insertion apparatus is structured to insert the ball 27 from the ball insertion slot 36 onto the wheel 22.

Figure 5:
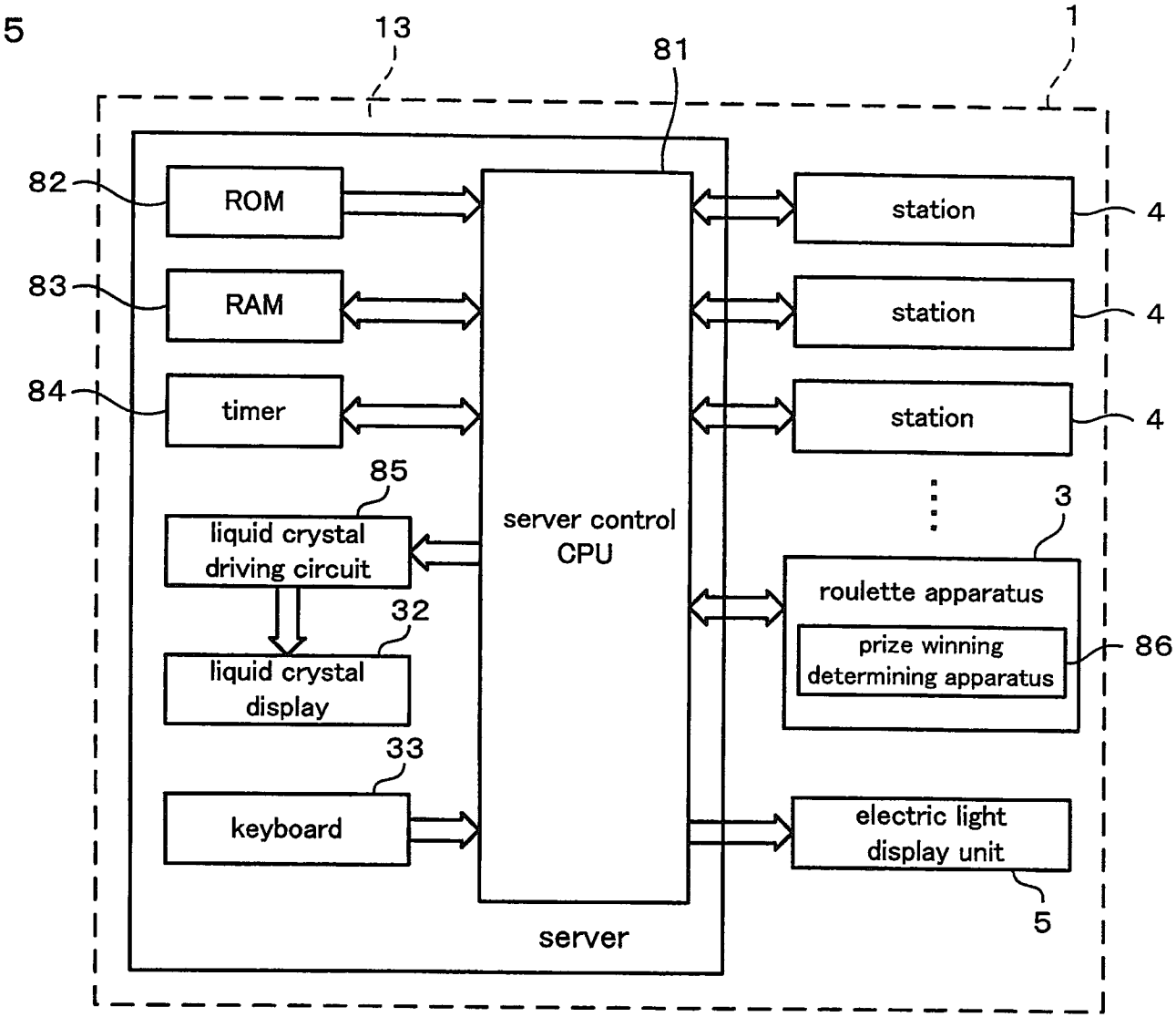
FIG. 5 is a perspective view of a server.

Further, the roulette apparatus 3 has a prize winning determining apparatus 86 of FIG. 5 and a ball collection apparatus (not shown). The prize winning determining apparatus 86 and the ball collection apparatus are disposed below the wheel 22. The prize winning determining apparatus 86 is an apparatus for determining the numbered pocket 23 into which the ball 27 is received. Further, the roulette apparatus 3 has the ball collection apparatus that is not shown. The ball collection apparatus is an apparatus for collecting the ball 27 on the wheel 22 after a roulette game is over. In the mean time, since the ball insertion apparatus, the prize winning determining apparatus and the ball collection apparatus have been already known, the detailed descriptions thereof will be omitted.

In the roulette apparatus 3 structured as described above, when a ball 27 is introduced on the frame 21 by the ball insertion apparatus, the guide wall 29 guises the ball 27 against the centrifugal force of the ball 27, thereby enabling the ball 27 to roll. When the centrifugal force is decreased as the rotation speed of the ball 27 is lowered, the ball 27 is rolled down along the inclined surface of the frame 21, is moved to the inside and reaches the wheel 22 being rotated. The ball 27, which is rolling-introduced onto the wheel 22, passes over the numbered plates 25 at the periphery of the wheel 22 and then is received in any one of the numbered pockets 23. As a result, the number indicated on the numbered plate 25 corresponding to the numbered pocket 23 having the ball 27 received therein is determined by the prize winning determining apparatus 86, so that a winning number is determined.

(Mechanical Structure: Server 13)

As illustrated in FIG. 3, the server 13 is disposed in a space provided on a wall surface of the cabinet 2. The server 13 is connected to each of the stations 4. The server 13 transmits a command signal to each of the stations 4 to take a leading part in controlling them, thereby progressing a game. Further, the server 13 executes maintenance of the roulette machine 1, in addition to controls related to a game run by the roulette game 1.

To the server 13 is connected a liquid crystal display 32 and a keyboard 33, as illustrated in FIG. 5. The liquid crystal display 32 displays a not-shown menu screen and a not-shown maintenance screen. Further, the keyboard 33 serves as operation means having thereon a plurality of keys. Operation of the keyboard 33 by a maintenance staff person, while the menu screen and the maintenance screen are displayed on the liquid crystal display 32, allows maintenance work for the roulette machine 1, in addition to various setting of the same.

(Mechanical Structure: Station 4)

As illustrated in FIG. 3, each of the stations 4 has a medal insertion slot 6, a control unit 7, and an image display apparatus 8. The medal insertion slot 6 is for inserting therethrough a game medium such as money, chips, medals, or the like required for a game. The control unit 7 includes operation parts such as a control button or the like. These operation parts are for allowing a player to input a predetermined instructions. The image display apparatus 8 displays an image related to a game, and has a game area for receiving a bet operation entered by a player. Thus, the image display apparatus 8 shows an image to a player, while allowing the player to operate the touch panel, the control unit 7, or the like.

Figure 6:
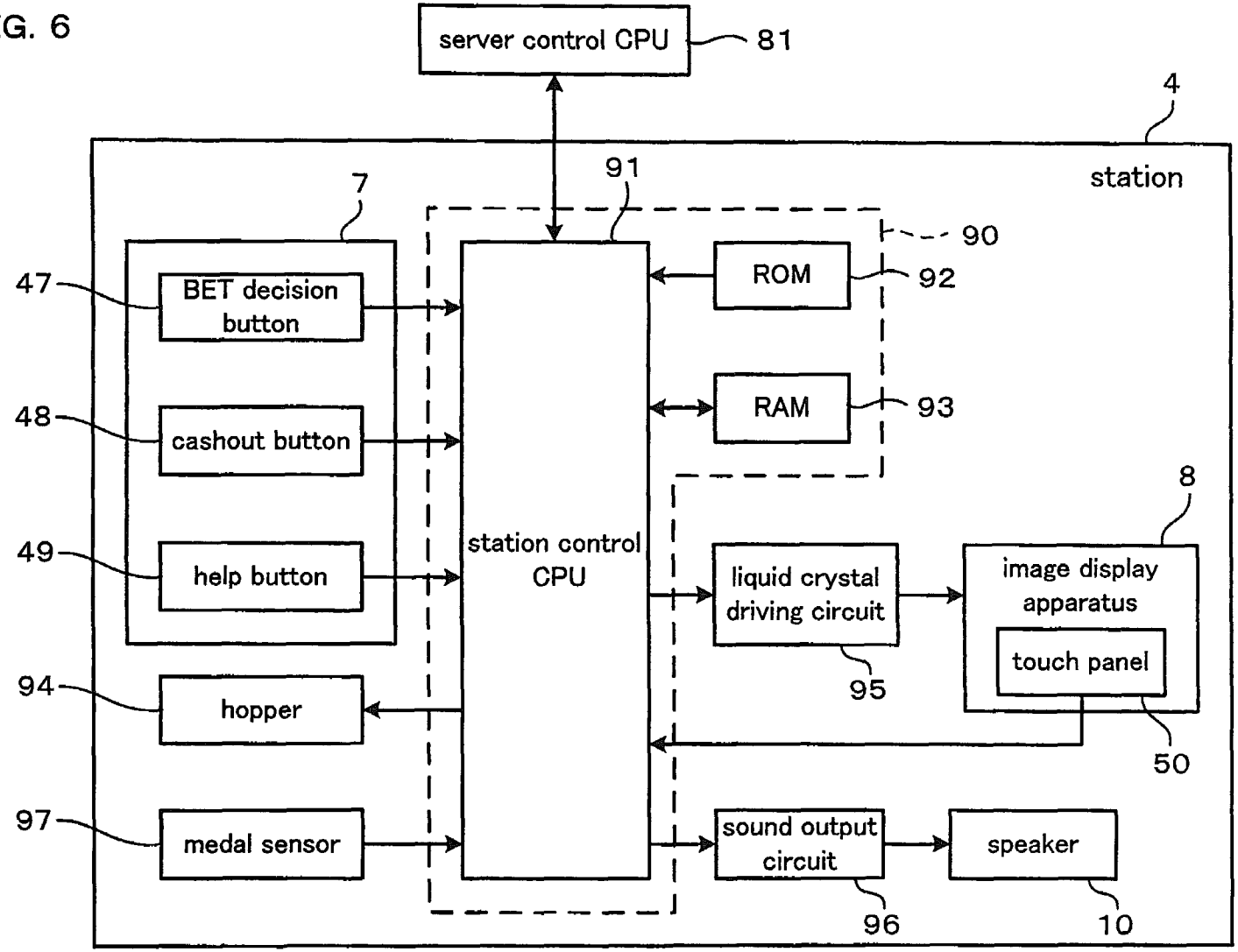
FIG. 6 is a block diagram showing a control system of a station.

A control unit 7 is disposed at a side of an image display apparatus 8. The control unit 7 has buttons each of which is operated by a player. To be more specific, as shown in FIG. 6, the control unit 7 has a BET decision button 47, a cashout button 48 and a help button 49. The BET decision button 47, the cashout button 48 and the help button 49 are disposed in an order from a left, seen from a position opposite to the station 4.

The BET decision button 47 is a button that is pushed when deciding a bet after a bet operation is carried out by means of an image display apparatus 8 that will be described later. Then, a bet is decided, and a prize winning is made when the bet is made on the number indicated on the numbered plate 25 corresponding to the numbered pocket 35 into which a ball 27 is received in the roulette apparatus 3 during a game. When a prize winning is made, the credits corresponding to the number of chips bet are added to the credits that a player possesses currently. In the mean time, the bet operation will be described more specifically.

The cashout button 48 is a button that is pushed typically when a game is over. When the cashout button 48 is pushed, the medals (typically, one medal for one credit), which correspond to the credits obtained through a game and the like and currently possessed by a player, are cashed out from a medal payout slot 9. The help button 49 is a button that is pushed when an operation method of a game is unclear, for example. When the help button 49 is pushed, a help screen that displays a variety of information on the image display apparatus 8 is displayed.

The image display apparatus 8 is a liquid crystal display of a touch panel type having the touch panel 50 attached to a front thereof. When an icon displayed on the liquid crystal is pushed with a finger and the like, the icon is selected. The display screen to be displayed on the image display apparatus will be specifically described later.

In addition, as shown in FIG. 3, the respective stations 4 have medal payout slots 9, speakers 10 and WIN lamps 11. The medal payout slots 9 are disposed at the sides of the cabinet 2. The speakers 10 are disposed above a right side of the image display apparatus 8. The WIN lamps 11 are disposed at sides of the speakers 10. The speakers 10 are used to output a music or effect music relating to a roulette game. The WIN lamps 11 are turned on/off when a bet number ("00", "0", "1"~"35" in this embodiment) is drawn in the station 4.

In the mean time, the WIN lamps 11 are disposed at positions that can be seen from all the stations 4 (12 stations in this embodiment). Thereby, the WIN lamps 11 enable another player to easily check a lighting state during the game in the same roulette gaming machine 1.

A medal sensor (not shown) is provided in the medal insertion slot 6. The medal sensor validates a medal inserted into the medal insertion slot 6 and counts the inserted medal. In addition, the medal payout slot 9 is connected to a hopper (not shown). The hopper pays out the predetermined number of medals from the medal payout slot 9.

(Electrical Structure: Server 13)

FIG. 5 is a block diagram that schematically shows a control system of a roulette gaming machine. As shown in FIG. 5, the roulette gaming machine 1 comprises a server 13 and a plurality of stations 4 (12 stations in this embodiment) connected to the server 13. The server 13 is connected to the roulette apparatus 3 and the electric light display unit 5. In the mean time, a control system of the station 4 will be specifically described later.

In addition, the server 13 comprises a server control CPU 81, a ROM 82 and a RAM 83 serving as a calculation device performing an entire control and a control device, a timer 84 connected to the server control CPU 81, a liquid crystal display 32 connected to the CPU through a liquid crystal driving circuit 85 and a keyboard 33.

The server control CPU 81 executes a variety of processes, based on input signals supplied from the respective stations 4 and data or program stored in the ROM 82 and the RAM 83. Thereby, the serve control CPU 81 transmits a command signal to the stations 4 based on execution results of the processes to initiatively control the respective stations 4, thereby progressing a game. Further, the server control CPU 81 drives a drive motor provided to the roulette apparatus 3, thereby shooting a ball 27 or rotating the wheel 22. Furthermore, the server control CPU 81 controls the prize winning determining apparatus 86, thereby determining a winning number based on a dropped position of the ball. Then, based on the winning number obtained and the bet information transmitted from the respective stations 4, the CPU determines a prize winning of the chips bet and calculates the credit-number to be paid out in each of the stations 4.

The ROM 82 consists of a semiconductor memory, for example. The ROM 82 stores a program for implementing basic functions of the roulette gaming machine 1, a payout rate for a roulette game (the number of credits to be paid out per one chip when a prize winning is made), a program for initiatively controlling the respective stations 4, and the like.

The RAM 83 temporarily stores the bet information of chips to be supplied from the respective stations 4, a winning number of the roulette apparatus 3 determined by a sensor, a JP amount that is accumulated up to now, data relating to a result of a process that is executed by the server control CPU 81, and the like.

Further, the server control CPU 81 is connected with the timer 84 that measures time. The time information of the timer 84 is transmitted to the server control CPU 81. The server control CPU 81 rotates the wheel 22 or introduces the ball 27, based on the time information of the timer 84, which will be described later.

In addition, the server control CPU 81 is connected with the electric light display unit 5. The server control CPU 81 controls light emission of a light emitting means such as LED to perform an effect by an electric spectacular and to display predetermined letters on the electric light display unit 5. Furthermore, the server control CPU 81 displays the JP amount, which is accumulated up to now, on the JP amount indicator 15 of the electric light display unit 5.

In addition, the ROM 82 is provided with a payout credit memory area in which a payout rate relating to a roulette game using the BET screen 61 is stored. The payout credit memory area stores data of a bet type or payout rate in a form of a payout management table shown in FIG. 7. The payout management table will be specifically described later.

Furthermore, the RAM 83 is provided with a bet information memory area in which the bet information of a player who is playing a game is stored. The bet information memory area stores data of bet information or participation object in a form of a station management table shown in FIG. 8. The station management table will be specifically described later. Further, the RAM 83 is provided with a winning number memory area in which a winning number of the roulette apparatus 3 determined by the prize winning determining apparatus is stored, a JP accumulation memory area 83 in which a pool amount having pooled 0.5% of the credits bet on the BET screen 61 is stored, and the like. In the mean time, the bet information is information about a bet that is made using the stations 4, such as the bet area 72 displayed on the BET screen 61, the number of bet chips (bet-number) and bet type.

(Electrical Structure: Station 4)

In the followings, a structure of a control system of the station 4 will be described. FIG. 6 is a block diagram showing a control system of the station according to an embodiment. In the mean time, the twelve stations 4 have a same structure, so that one station 4 will be described as an example.

The station 4 consists of a station control unit 90 and several peripheral devices. The station control unit 90 comprises a station control CPU 91, a ROM 92 and a RAM 93. The ROM 92 consists of a semiconductor memory, for example. The ROM 92 stores a program for implementing basic functions of the station 4, various programs necessary for controlling the station 4, a data table and the like. In addition, the RAM 93 is a memory that temporarily stores various data calculated in the station control CPU 91, the number of credits that are currently possessed by a player (i.e., stored in the station 4), a bet situation of chips by a player, and the like.

In addition, the station control CPU 91 is connected to a BET decision button 47, a cashout button 48 and a help button 49, which are equipped in the control unit 7. Based on operation signals outputted as the respective buttons are pushed, the station control CPU 91 performs a control so as to execute the corresponding operations. To be more specific, based on an input signal that is inputted from the control unit 7 as an operation of a player is received and the data or program stored in the ROM 92 and the RAM 93, the station control CPU executes a variety of processes and transmits the results thereof to the server control CPU 81. In the mean time, the station control CPU 91 receives a command signal from the server control CPU 81, controls the peripheral devices constituting the station 4 and progresses a roulette game in the station 4. In addition, the station control CPU 91 executes a variety of processes, based on an input signal that is inputted from the control unit 7 as an operation of a player is received and the data or program stored in the ROM 92 and the RAM 93, depending on contents of process, controls the peripheral devices constituting the station 4 based on the process results and progresses a roulette game in the station 4.

In addition, the station control CPU 91 is connected to a hopper 94. The hopper 94 pays out the predetermined number of medals from the medal payout slot 9 in accordance with a command signal from the station control CPU 91. Furthermore, the station control CPU 91 is connected with an image display apparatus 8 through a liquid crystal driving circuit 95. In regard to this, the liquid crystal driving circuit 95 consists of a program ROM, an image ROM, an image control CPU, a work RAM, a VDP (video display processor), a video RAM and the like. The program ROM stores an image control program for display on the image display apparatus 8, a variety of selection tables and the like.

In addition, the image ROM stores dot data for forming an image to be displayed on the image display apparatus 8, for example. The image control CPU determines an image to be displayed on the image display apparatus 8 from the dot data previously stored in the image ROM, in accordance with an image control program previously stored in the program ROM, based on parameters set in the station control PCU 91. In addition, the work RAM consists of a temporary memory means used when the image control program is executed in the image control CPU. In addition, the VDP forms an image relating to contents of display determined in the image control CPU and outputs the image on the image display apparatus 8. In the mean time, the video RAM consists of a temporary memory means used when an image is formed in the VDP.

In addition, a touch panel 50 is attached on a front of the image display apparatus 8. Operation information of the touch panel 50 is transmitted to the station control CPU 91. On the touch panel 50, a player makes a bet operation with chips in the BET screen 61. To be more specific, a player operates the touch panel 50 with regard to a selection of the bet area 72, an operation of a unit BET button 61 and the like, and the operation information is transmitted to the station control CPU 91. Based on the information, the current bet information of a player (a bet area indicated in the BET screen 61 and the number of chips bet) is stored in the RAM 93 at all times. Furthermore, the bet information is transmitted to the server control CPU 81 and is stored in the bet information memory area of the RAM 83.

Furthermore, a sound output circuit 96 and a speaker 10 are connected to the station control CPU 91. The speaker 10 generates a variety of effect sounds when performing various effects, based on an output signal from the sound output circuit 96.

In addition, a medal sensor 97 is connected to the station control CPU 91. The medal sensor 97 detects medals inserted from the medal insertion slot 6, calculates the inserted medals and transmits a result thereof to the station control CPU 91. The station control CPU 91 increases the credit-number possessed by a player, which is stored in the RAM 93, based on the transmitted signal.

In addition, a WIN lamp 11 is connected to the station control CPU 91. When the chip bet in the BET screen 61 is determined to make a prize winning or JP, the station control CPU 91 turns on/off the WIN lamp 11 in a predetermined color.

(Data Table)

In the followings, a payout management table of FIG. 7 will be described. The data of the payout management table is stored in the ROM 82 of the server 13 shown in FIG. 5. The payout management table has a column of numbers, a column of types and a column of payout rates. The data of numbers such as "1", "2", "3" and the like are stored in the column of numbers. The data showing bet types such as "Straight", "Split", "Street" and the like are stored in the column of bet types. The bet types will be specifically described later. The data showing the payout rates such as "35:1", "17:1", "11:1" and the like are stored in the column of payout rates, correspondingly to the bet types. Thereby, when a bet is made in a bet type of "Straight", 35 pieces will be paid out per 1 piece bet.

In the followings, a station management table of FIG. 8 will be described. In the mean time, the station management table corresponds to the bet memory 121 of FIG. 2. The station management table is stored in the RAM 83 of the server 13 shown in FIG. 5. The station management table has a column of stations, a column of bet information having a column of bet types and a column of bet-numbers and a column of participation objects. The column of stations stores the machine number data inherent to each station 4. The column of bet types stores the bet type data such as "Straight." The column of bet-numbers stores the number of pieces bet such as "20." The column of participation objects stores the data showing whether a participation object has a possibility that a special payout will be awarded thereto. In the mean time, the "1" in the column of participation objects shows that it is set as a participation object and "0" shows that it is not set as a participation object.

Thereby, for example, in the station 4 having a machine number of "1", a bet is made for each of the bet types of "Straight" and "Corner", a bet pattern has a bet-number of "20" for each bet type and it is shown the participation object of "1." In addition, in the station 4 having a machine number of "2", a bet is made for the bet type of "Red", a bet pattern has a bet-number of "15" for the bet type and it is shown the non-participation object is "0."

In the followings, a bet pattern table of FIG. 9 will be described. The bet pattern table is provided same as the number of the stations 4 and is made to correspond to the each of the stations 4. The data of the station management table is stored in the RAM 83 of the server 13 shown in FIG. 5. In the mean time, the bet pattern table may be stored in a memory device such as hard disk, which corresponds to the bet pattern memory device 106 of FIG. 2 and is connected to an outside of the server 13.

The bet pattern table has a column of pattern numbers and a column of bet information having a column of bet types and a column of bet-numbers. The column of bet numbers stores the data of pattern numbers such as "1," "2" and "3" showing contents of registration of bet patterns. The column of bet types stores the data of bet types such as "Straight." The column of bet-numbers stores the number of pieces bet such as "20."

Thereby, when a pattern number of "1" is selected in the station 4, a bet is made for each of the bet types including "Straight" and "Corner" and the bet is made in a bet pattern in which the bet-number is "20" for each of the bet types. In addition, when a pattern number "2" is selected in the station 4, a bet is made for the bet type corresponding to the pattern number "2" and the bet is made in a bet pattern having the bet-number for the bet type.

(Display States of the Image Display Apparatus 8)

Figure 10:
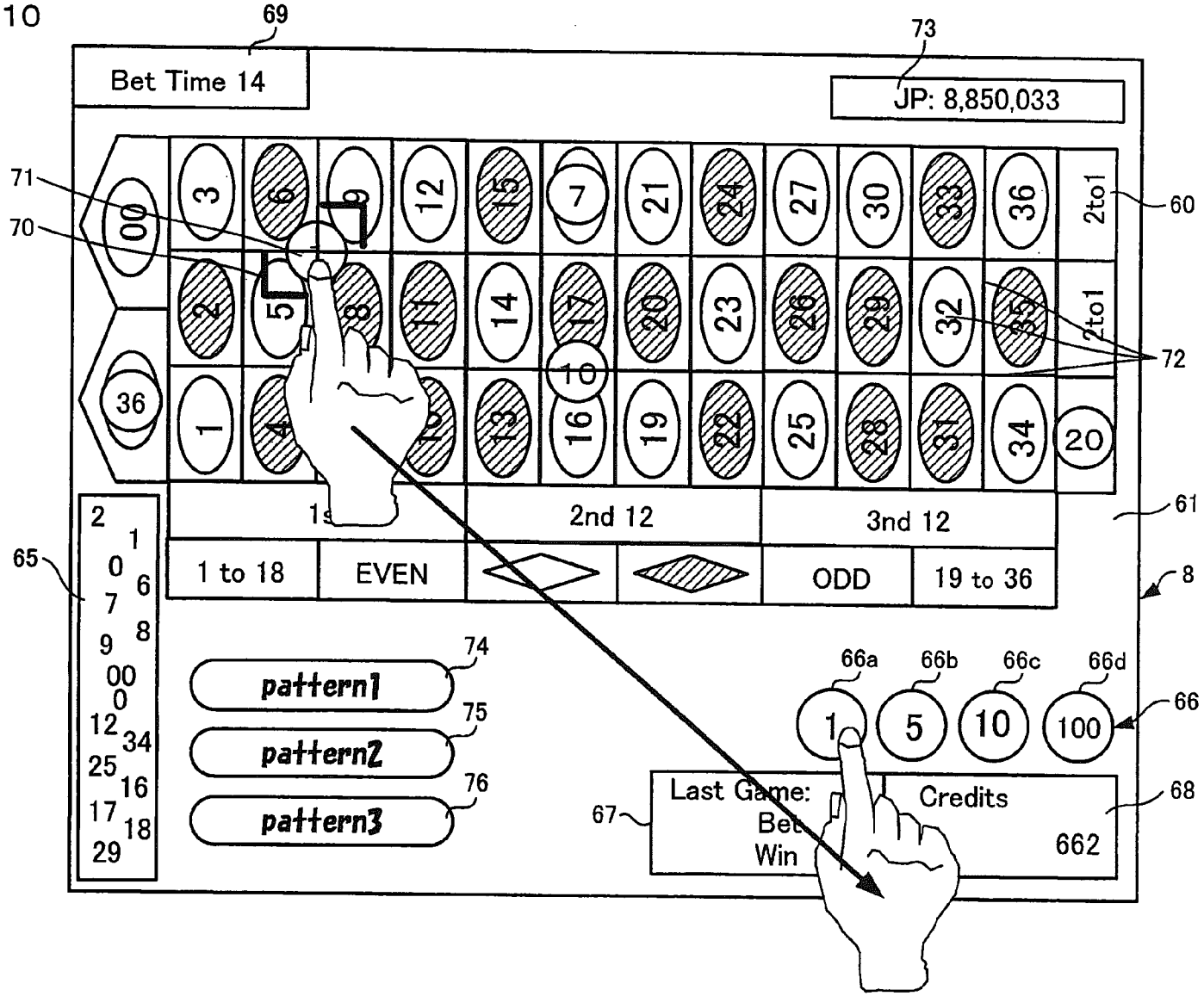
FIG. 10 illustrates a display state of an image display apparatus.

In the followings, display states of the image display apparatus 8 will be specifically described with reference to FIGS. 10 to 12. FIG. 10 shows a state in which a player makes a bet manually. In a display screen of the state, a BET screen 61 having a table-type betting board 60 is displayed. A player can operate the BET screen 61 to bet a chip using the credits possessed.

In the table-type betting board 60 that is displayed in the BET screen 61, the 38 numbers of "0," "00," and "1~36" are arranged in a grid form. In addition, special bet areas for indicating "odd number", "even number", "types of colors of numbered plates (red or black)" and "a predetermined range of numbers (for example, "1"~"12") to bet a chip are also arranged in a grid form.

At a lower part of the table-type betting board 60, a result history indicator 65, unit BET buttons 66, a cashout result indicator 67 and a credit-number indicator 68 are sequentially displayed from left of the screen. The result history indicator 65 displays, in a list form, results of winning numbers up to the previous games (here, one game is a series of operations that a player performs a bet in each of the stations 4, a ball 27 is dropped in the numbered pocket 23 and a credit is paid out based on a winning number). At this time, when one game is over, a winning number is additionally displayed from top and a history of maximum 16 winning numbers can be checked.

The unit BET buttons 66 are provided for a player to bet a chip on bet areas 72 (above the grids of number and mark or above lines forming a grid) indicated by the player. The unit BET buttons 66 consist of a 1 BET button 66A, a 5 BET button 66B, a 10 BET button 66C and a 100 BET button 66D. A player first pushes the screen with a finger, thereby indicating a bet area 72, on which a bet is made, with a cursor 70. At this state, when the player pushes the 1 BET button 66A, the player bets a chip in a unit of one piece (whenever the 1 BET button 66A is pushed with a finger, the bet-number is increased in an order of "1"→"2"→"3" . . . ). In addition, when the player pushes the 5 BET button 66B, the player bets chips in a unit of five pieces (whenever the 5 BET button 66B is pushed with a finger, the bet-number is increased in an order of "5"→"10"→"15" . . . ). In addition, when the player pushes the 10 BET button 66C, the player bets chips in a unit of ten pieces (whenever the 10 BET button 66C is pushed with a finger, the bet-number is increased in an order of "10"→"20"→"30" . . . ). Furthermore, In addition, when the player pushes the 100 BET button 66D, the player can bet chips in a unit of 100 pieces (whenever the 100 BET button 66D is pushed with a finger, the bet-number is increased in an order of "100"→"200"→"300" . . . ). Accordingly, even when many chips are bet, an operation thereof can be simplified.

In addition, the cashout result indicator 67 displays the number of chips bet by a player in a previous game and the cashout credit-number. Here, the subtraction of the bet-number from the cashout credit-number results in a credit-number that is newly obtained by a player in a previous game.

Furthermore, the credit-number indicator 68 displays the number of credits possessed by a current player. When a chip is bet, the credit-number is decreased in proportional to the bet-number (one credit for one bet). In addition, when a prize winning is determined for the chip bet and the cashout of credits is performed, the credit-number is increased as the cashout-number. In the mean time, when the credit-number possessed by a player is 0, the game is over.

A BET time indicator 69 is disposed above the table-type betting board 60. The BET time indicator 69 displays a remaining time period for which a player can make a bet. When a bet operation is received, "20") is displayed and the number is decreased by 1 every one second. When the number is "0," a bet operation is not received. In addition, in each of the stations 4, when the bet time of the player is 5 seconds, the ball insertion apparatus is driven to insert the ball 27 on the roulette wheel.

Furthermore, a JP indicator 73, which displays the credit-number of JP accumulated up to now, is disposed at the right of the BET time indicator 69. Here, the JP indicator 73 displays a value to which 0.5% of credits bet in the twelve stations 4 is accumulatively added and is common to all the stations 4. When a special payout, which is carried out in combination with a roulette game under predetermined condition, is made, a prize winning of JP is determined and the credit-number corresponding to a special payout symbol among the JP is paid out. In the mean time, the credit-number of JP that is accumulated up to now is also displayed on the JP amount indicator 15 of the electric light display unit 5.

In addition, a cursor 70 showing the bet area 72 selected by a player is displayed on the table-type betting board 60. Additionally, a chip mark 71 showing the number of chips that are bet up to now and the bet area 72 is displayed and the number shown on the chip mark 71 indicates the number of chips bet.

When a player wants to individually bet the bet elements in the BET screen 71 structured as described above, the player indicates a bet area 72 to be bet (above the grids of number and mark or above lines forming a grid) and directly pushes it with a finger. As a result, the cursor 70 is moved to the bet area 72 indicated. Then, when the respective unit buttons of the unit BET buttons 66 (1 BET button 66A, 5 BET button 66B, 10 BET button 66C, 100 BET button 66D) are pushed, the chips as the unit number are bet on the bet area 72 indicated.

For example, when the 10 BET button 66C is pushed four times, the 5 BET button 66B is pushed one time and the 1 BET button 66A is pushed three times, 48 chips can be bet.

Figure 11:
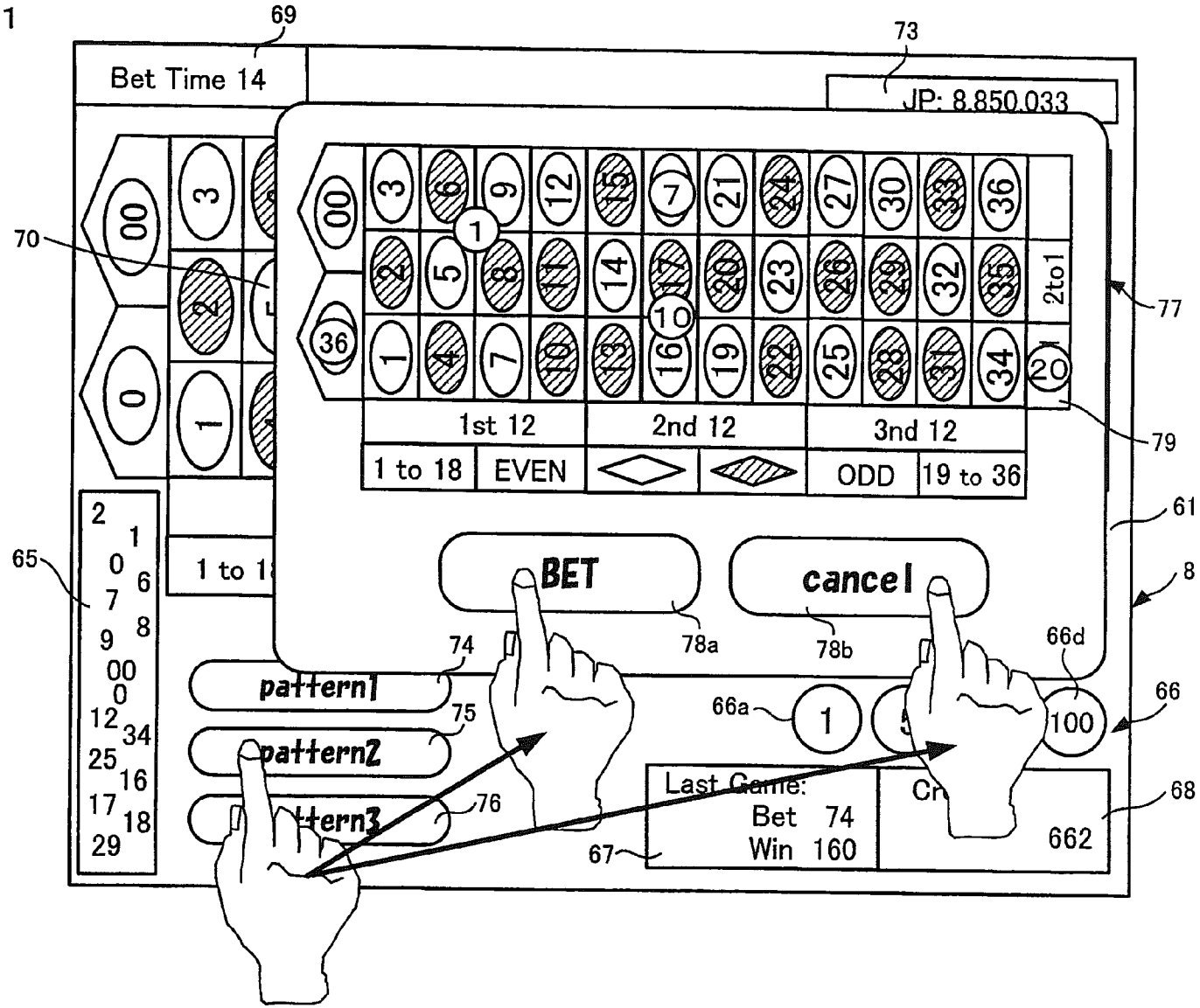
FIG. 11 illustrates a display state of an image display apparatus.

FIG. 11 shows a state in which a memory bet is performed. Pattern buttons 74, 75, 76 are disposed between the result history indicator 65 and the cashout result indicator 67. The pattern buttons 74, 75, 76 are marked with "pattern 1," "pattern 2" and "pattern 3" so that a player can recognize the independent operations thereof with naked eyes. Each of the pattern buttons 74, 75, 76 corresponds to the bet patterns that registered by a player. In the mean time, the pattern buttons 74, 75, 76 may be configured such that the different bet patterns bet in the newest game can be automatically registered, respectively.

When a player intends to collectively bet the bet patterns in the BET screen 61 structured as described above, the player first pushes the pattern buttons 74, 75, 76 corresponding to the desired bet patterns, directly. As a result, a pattern check screen 77 appears above the table-type betting board 60. The pattern check screen 77 comprises a pattern indicator 79 showing a state of bet patterns to be bet, a bet decision button 78*a* for actually betting the bet patterns of the pattern indicator 79 and a cancel button 78*b* for returning to a state before the pattern buttons 74, 75, 76 are pushed.

Thereby, when a player pushes one of the pattern buttons 74, 75, 76, the pattern check screen 77 appears, so that it is possible to check whether a bet pattern of the pattern check screen 77 is a desired bet pattern. When it is determined that the bet pattern is not a desired bet pattern, the player pushes the cancel button 78*b*, so that the pattern check screen 77 disappears. In the mean time, when it is determined that the bet pattern is a desired bet pattern, the player pushes the bet decision button 78*a* so that the bet pattern of the bet check screen 77 can be actually bet. As a result, since the bet pattern desired by the player is implemented by the several push operations, it is possible to reduce the burden of the player to the bet.

Figure 12:
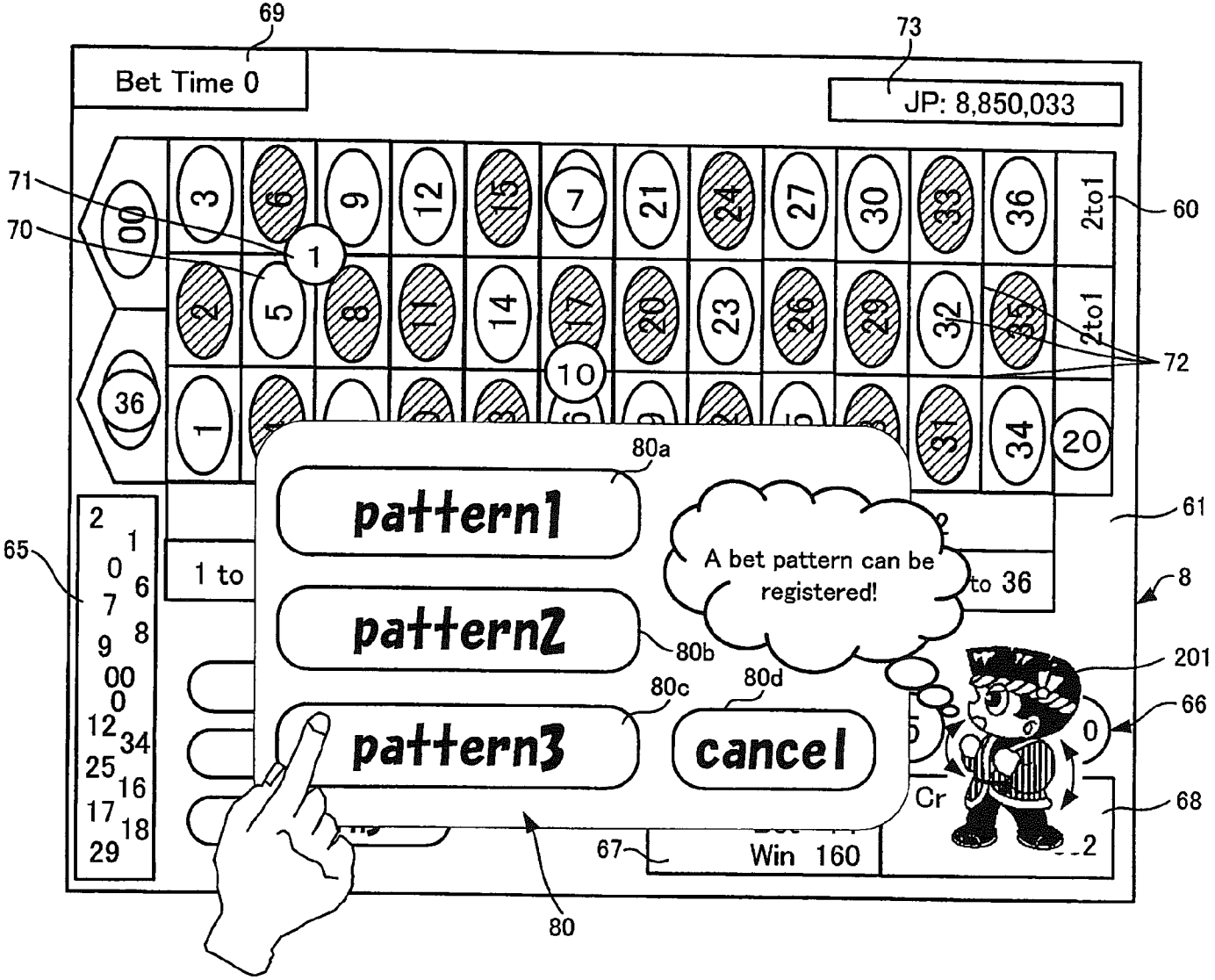
FIG. 12 illustrates a display state of an image display apparatus.

FIG. 12 shows a state in which the bet patterns are registered to correspond to the pattern buttons 74, 75, 76. When the bet time is over, a bet pattern registration screen 80 appears for a predetermined time period. The bet pattern registration screen 80 comprises pattern imitation buttons 80*a*, 80*b*, 80*c* corresponding to the pattern buttons 74, 75, 76 and a cancel button 80*d*. Furthermore, as the cancel button 80*d* appears, a character 201 appears near to the bet pattern registration screen 80. The character 201 notifies that a bet pattern can be registered.

Thereby, when there is a possibility that the current bet patterns will be repeated in a next game, a player pushes the pattern imitation buttons 80*a*, 80*b*, 80*c*, so that the current bet patterns are correspondingly registered to the pattern buttons 74, 75, 76 corresponding to the pattern imitation buttons 80*a*, 80*b*, 80*c* pushed. In the mean time, when the cancel button 80*d* is pushed, the current bet patterns are not registered.

Then, when a predetermined time period has elapsed after the bet pattern registration screen 80 appears, or when any one of the pattern imitation buttons 80*a*, 80*b*, 80*c* and the cancel button 80*d* is pushed, the bet pattern registration screen 80 disappears.

(Bet Types)

In the followings, the bet types will be described with reference to the betting board 60 of FIG. 10. For example, the chip mark 71 of "7", which is put on the grid of "18", indicates that 7 chips are bet on the number "18." Like this, the bet type in which a bet is made on one number only is referred to as a "Straight bet."

The chip mark 71 of "1", which is put on an intersection of the grids of "5", "6", "8" and "9", indicates that one chip is bet while covering the four numbers of "5", "6", "8" and "9." Like this, the bet type in which a bet is made while covering the four numbers is referred to as a "Corner bet."

In addition, there is a bet type of "Split bet" in which a bet is made while covering two numbers above a line between the two numbers. In addition, there is a bet type of "Street bet" in which a bet is made while covering three numbers at ends of the one row of the numbers (one column in the vertical direction). In addition, there is a bet type of "Five bet" in which a bet is made while covering five numbers of "0", "00", "1", "2" and "3" above a line between "00" and "3".

There is a bet type of "Line bet" in which a bet is made while covering six numbers (for example, "13", "14", "15", "16", "17" and "18") between two rows of the numbers (two columns in the vertical direction). There is a bet type of "Column bet" in which a bet is made while covering 12 numbers above the grid of "2 to 1". There is a bet type of "Dozen bet" in which a bet is made while covering 12 numbers above the grids of "1st 12", "2nd 12" and "3rd 12", respectively.

Furthermore, there is a bet type of "Red or Black bet" in which a bet is made on the color of the numbered plate ("red" or "black") using the six grids provided at the lowest end of the table-type betting board 60. There is a bet type of "Odd or Even bet" in which a bet is made on the odd or even numbers. There is a bet type of "Low or High bet" in which a bet is made while 18 numbers using the numbers of 18 or less or 19 or more. Here, the bet types have different payouts (payout rates) of the credits per one chip, which are awarded when the chip bet is determined as a prize winning.

(Processing Operations)

In the followings, the operations will be described, based on a game processing program of the server that is executed by means of the server control CPU 81 of the roulette gaming machine 1, and a game processing program of the station that is executed by the station control CPU 91 of the station 4. In the mean time, the respective programs that are shown in flow charts are stored in the ROM 82 or RAM 83 of the server 13 or the ROM 92 or RAM 93 of the station 4 and executed by the server control CPU 81 or station control CPU 91.

(Game Process Performed in the Station)

Figure 13:
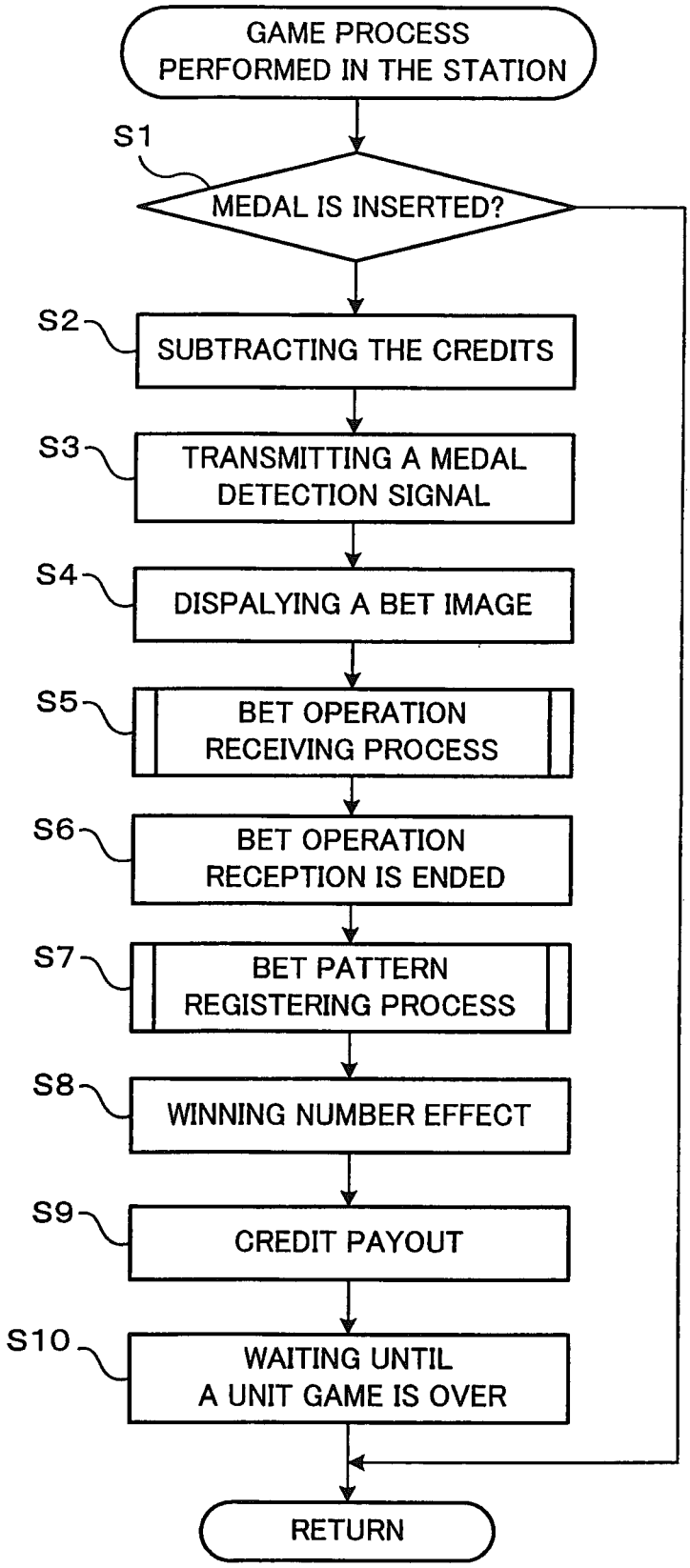
FIG. 13 is a flow chart of a game process routine performed in a station.

In the followings, a game process performed in the station will be described with reference to FIG. 13. Firstly, it is determined whether a medal or bill is inserted by a player, based on a detection signal of the medal sensor 97 (S1). When a medal or bill is not inserted (S1, NO), this routine is ended, the step of S1 is repeatedly executed and the wait state is sustained until a medal or bill is inserted.

In the mean time, when a medal or bill is inserted (S1, YES), the credit data of an amount of money corresponding to the number of pieces inserted is recorded in the RAM 93, so that the credit is added (S2). Then, a medal detection signal indicating that a medal or bill is inserted is transmitted to the server 13 (S3).

Then, in the image display apparatus 8 of the station 4, the BET screen 61 of FIGS. 1 and 10 is displayed and a bet time for which a player can bet a chip is started (S4). Then, a bet operation receiving process is executed (S5). Thereby, a player who takes part in a game can select any one or both of a manual bet and a memory bet during the bet time for which a bet operation can be received. The bet operation receiving operation will be specifically described below.

In addition, the player can take part in a game in the course of the game after the bet time is started. In the roulette gaming machine 1 of this embodiment, maximum 12 players can play a game. Furthermore, when this time game is carried out following the previous game, a bet operation is received just after the previous game is over.

When a bet operation is performed, a bet information signal including the contents of the bet operation is transmitted to the server 13 (S6). Then, when a bet time end signal is received from the server 13, an image notifying that the bet time is over is displayed on the image display apparatus 8 of the station 4 and the reception of the bet operation on the touch panel 50 is ended (S6).

When the bet time is over as described above, a bet pattern registering process is executed (S7). Thereby, the current bet patterns can be re-used just by pushing the pattern buttons 74, 75, 76 in a subsequent game, which will be specifically described below. Then, when a winning number signal, which is a game result of the roulette game, is received from the server 13, a display process of emphasizing the winning number is performed, so that an effect for notifying the wining number in the roulette game is carried out (S8). Then, when a payout result signal is received from the server 13, the credits are paid out based on the payout result signal. To be more specific, the credit data of a base payout or special payout is recorded in the RAM 93, respectively. When the cashout button 48 is pushed, the medals relating to the credit-number currently stored in the RAM 93 are cashed out from the medal payout slot 9 (S9). Then, it is under wait state. When a unit game end signal is received form the server 13 (S10), this routine is ended. Then, a bet reception for a next unit game is restarted.

In the mean time, the bet pattern registering process may be performed at any time, as long as it is performed after the bet time is over. For example, the bet pattern registering process may be carried out simultaneously with the credit payout process or may be performed during the wait time until the unit game is over. Furthermore, the bet pattern registering process may be performed at the timing of operating a registering button (not shown) that is disposed at the side of the pattern buttons 74, 75, 76. In this case, a player can register the bet patterns at an appropriate timing in all the time of a game.

(Bet Operation Receiving Process)

Figure 14:
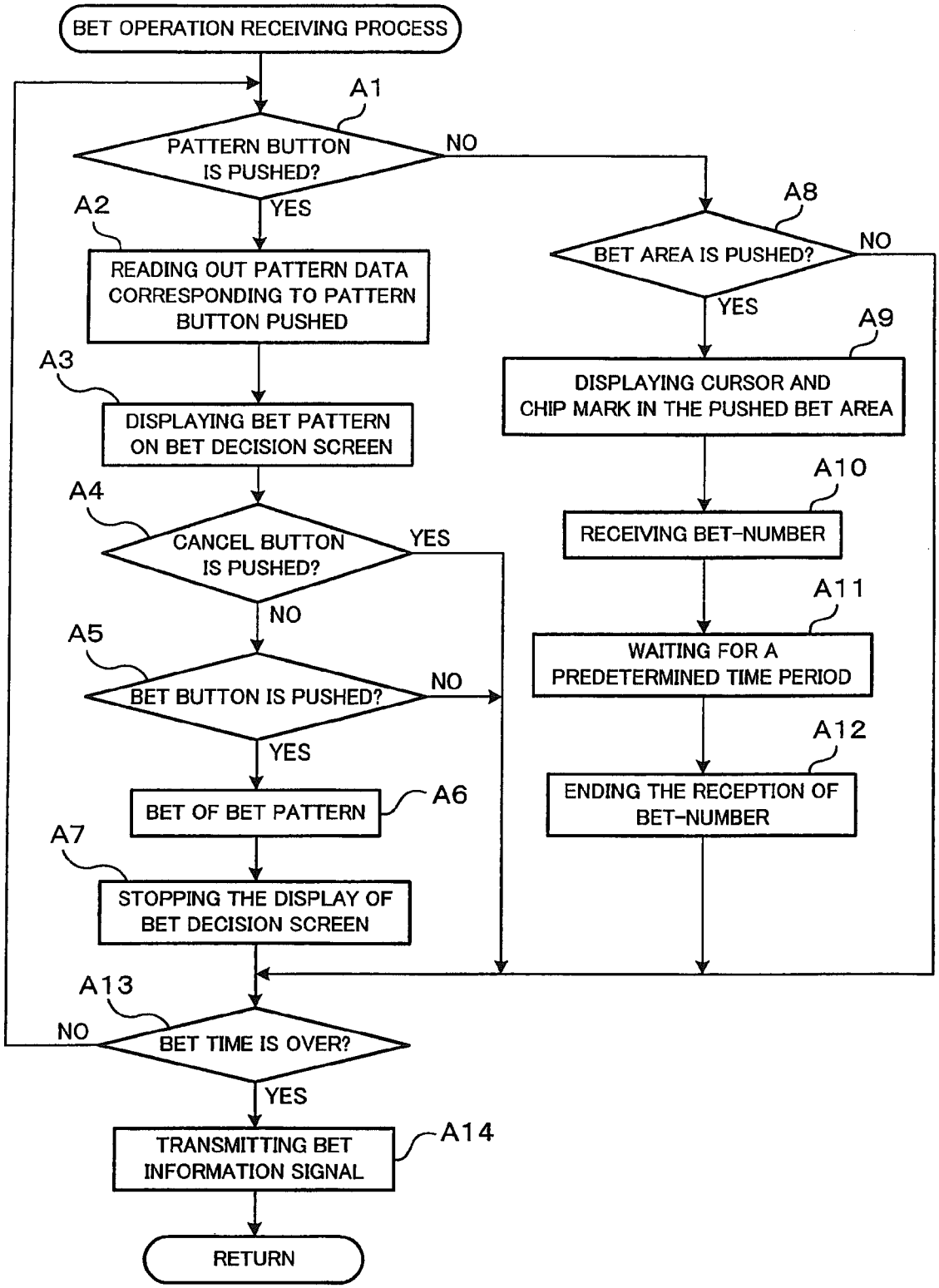
FIG. 14 is a flow chart of a bet operation reception process routine.

The bet operation receiving process that is executed in the game process of the station will be specifically described with reference to a flow chart of FIG. 14. As shown in FIGS. 10 and 11, it is determined whether the pattern buttons 74, 75, 76 are pushed or not (A1). When the pattern buttons 74, 75, 76 are not pushed (A1, NO), it is continuously determined whether the bet area 72 is pushed (A8). When the bet area is not pushed (A8, NO), it is determined whether a bet time period is over (A13). When a bet time period is not over (A13, NO), the process is re-executed from the step of A1. In the mean time, when a bet time period is over (A14, YES), a bet information signal is outputted (A14), this routine is then ended and the process is returned to the game process of the station shown in FIG. 13. Thereby, the state in which a manual bet and a memory bet are received is maintained in the bet time period.

When the bet area 72 is pushed (A8, YES), the cursor 70 is displayed in the bet area 72 pushed, as shown in FIG. 10 (A9). In addition, the chip mark 71 showing the number of chips bet up to now and the bet area 72 is displayed and the number of chips bet is shown by means of the number indicated on the mark 71.

Then, it is under state of receiving the operations of the respective buttons (1 BET button 66A, 5 BET button 66B, 10 BET button 66C, 100 BET button 66D) of the unit BET buttons. When the buttons are pushed, the chips as the unit numbers are bet on the bet area 72 indicated. For example, when the 10 BET button 66C is pushed four times, the 5 BET button 66B is pushed one time and the 1 BET button 66A is pushed three times, a total of 48 chips is bet (A10).

Then, the wait state is kept for a predetermined time period, so that the reception of the bet-number is maintained (A10). When the wait time has elapsed, it is notified that the reception of the bet-number is ended, after the reception of the bet-number is completed (A12). Then, it is determined whether the bet time period is over (A13).

When the pattern buttons 74, 75, 76 are pushed (A1, YES), the bet pattern data corresponding to the pattern buttons 74, 75, 76 pushed is read out (A2). Then, the bet pattern is displayed on the pattern check screen 77 (A3) and then it is determined whether the cancel button 78*b* is pushed or not (A4). When the cancel button 78*b* is pushed (A4, YES), it is determined whether the bet time period is over (A13). In the mean time, when the cancel button 78*b* is not pushed (A4, NO), it is continuously determined whether the bet decision button 78*a* is pushed (A5). When the bet decision button 78*a* is not pushed (A5, NO), it is determined whether the bet time period is over (A13). When the bet decision button 78*a* is pushed (A5, YES), a bet is made in accordance with the bet pattern displayed on the pattern check screen 77 (A6). Then, after the display of the pattern check screen 77 is stopped, i.e., eliminated (A7), it is determined whether the bet time period is over (A13).

When the bet time period is not over (A13, NO), the above processes are repeated. In the mean time, when the bet time period is over (A13, YES), a bet information signal is outputted (A14), this routine is over and the process is returned to the game process of the station shown in FIG. 13.

(Bet Pattern Registering Process)

Figure 15:
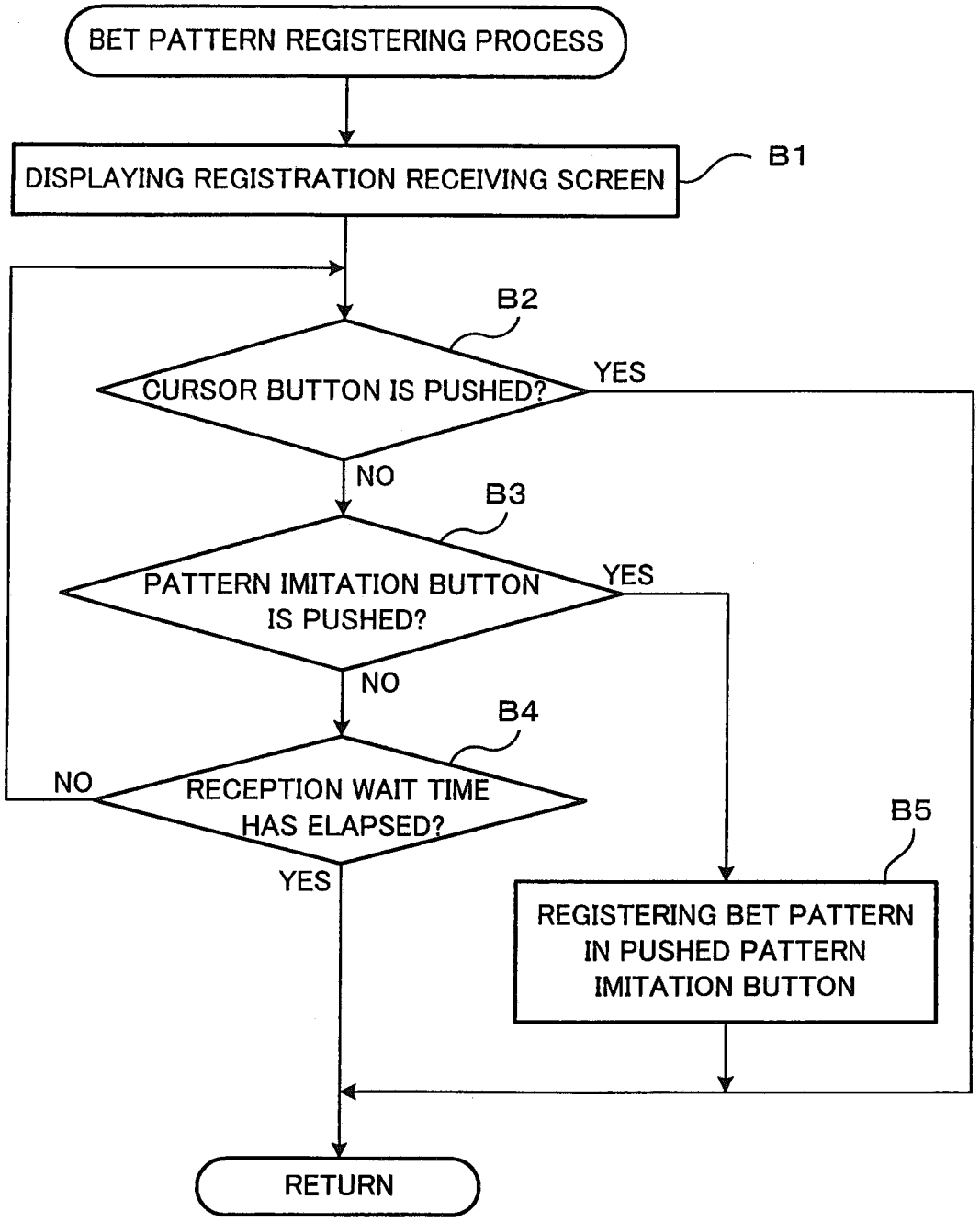
FIG. 15 is a flow chart of a bet pattern registering process.

The bet pattern registering process that is performed in the game process of the station will be described with reference to a flow chart shown in FIG. 15. As shown in FIG. 12, when this process is executed, a bet pattern registration screen 80 appears as a registration receiving screen (B1). Then, it is determined whether the cancel button 80*d* is pushed (B2). When the cancel button 80*d* is pushed (B2, YES), this routine is ended.

In the mean time, when the cancel button 80*d* is not pushed (B2, NO), it is continuously determined whether the pattern imitation buttons 80*a*, 80*b*, 80*c* serving as pattern indicating buttons are pushed (B3). When the pattern imitation buttons 80*a*, 80*b*, 80*c* are pushed (B3, YES), the current bet pattern is registered in the pattern buttons 74, 75, 76 corresponding to the pattern imitation buttons 80*a*, 80*b*, 80*c* pushed (B5). Then, this routine is ended.

In the mean time, when the pattern imitation buttons 80*a*, 80*b*, 80*c* are not pushed (B3, NO), it is continuously determined whether a reception wait time period has elapsed (B4). When a reception wait time period has not elapsed (B4, NO), the process is re-executed from the step of B2. When a reception wait time period has elapsed (B4, YES), this routine is ended. Thereby, a player can register a desired bet pattern in the desired pattern buttons 74, 75, 76 just by pushing the pattern imitation buttons 80*a*, 80*b*, 80*c*.

(Game Process Performed in the Server)

Figure 16:
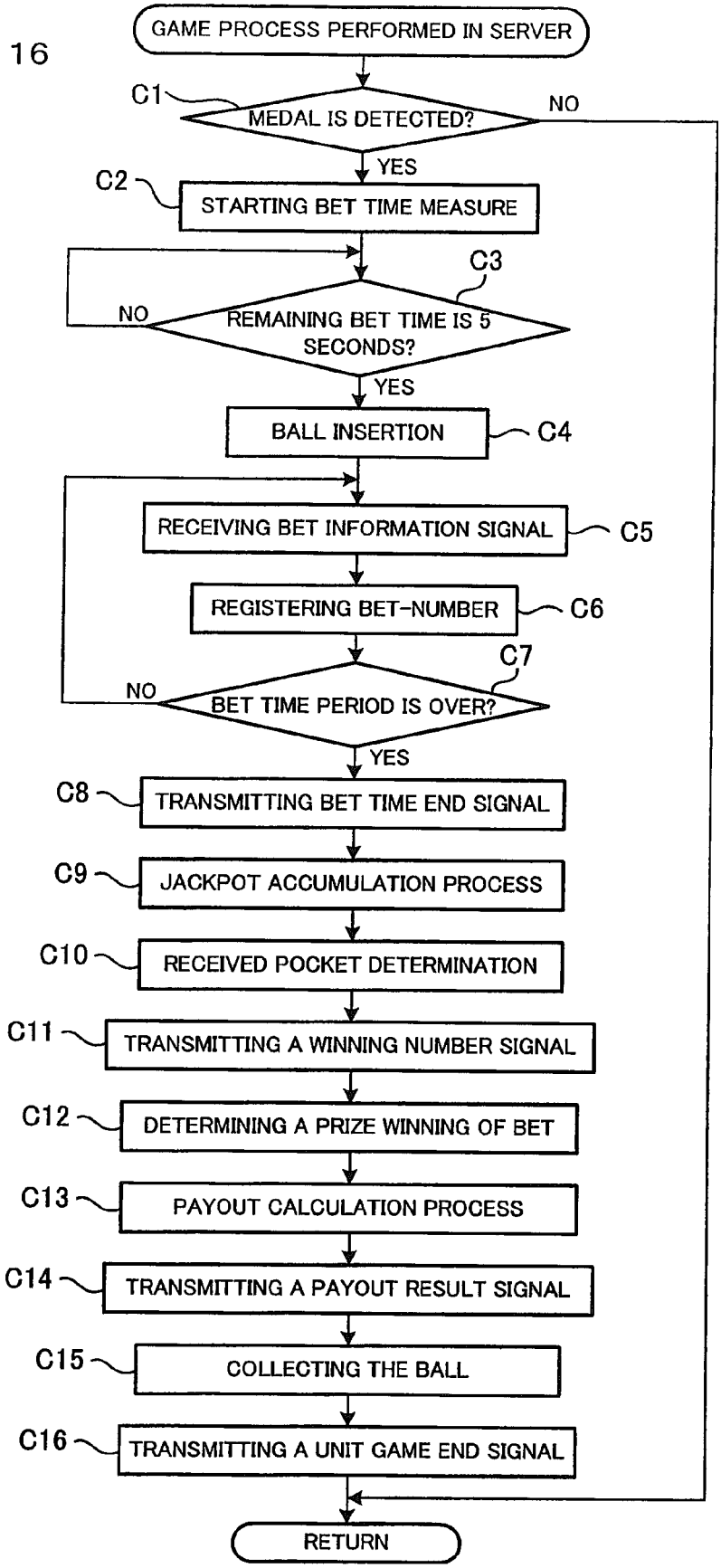
FIG. 16 is a flow chart of a process performed in a server.

In the followings, a game process of the server will be described with reference to FIG. 16. It is determined whether a player inserts a coin or bill by receiving a medal detection signal transmitted from the station 4 (C1). When a medal detection signal is not received (C1, NO), this routine is ended. Thereby, the step of C1 is repeated until a medal and the like is inserted in the station 1.

When a medal and the like is inserted in the station 3 (C1, YES), it is started a measure of a bet time period that is a reception period for which a player can make a bet, from the time at which the first player inserts a medal or bill (C2). In the mean time, when this time game is executed following the previous game, a bet time is started just after the previous game is over. A player who takes part in a game can operate the touch panel 50 for the bet time period, thereby betting the chips on the bet area 72 related to the number that the player expects.

Then, it is determined whether the remaining bet time is 5 seconds (C3). In the mean time, the remaining bet time is also displayed on the image display apparatus 8 by means of the BET time indicator 69. When it is determined that the remaining bet time does not 5 seconds (B3, NO), the step of S3 is re-executed, so that the wait state is kept until the remaining bet time is 5 seconds. Meantime, when it is determined that the remaining bet time is 5 seconds (B3, YES), a roulette lottery process is executed in the roulette apparatus 3.

To be more specific, the ball insertion apparatus is driven, so that the ball 27 is inserted into the roulette wheel (C4). Then, the driving motor is driven, so that the wheel 22 is rotated at a predetermined rotation speed in a direction opposite to the ball insertion direction. The inserted ball 27 rolls on the roulette wheel along the guide wall 29. Then, when the rotation speed is lowered and the centrifugal force is thus reduced, the ball is dropped along the inclined surface of the frame 21 and thus reaches the wheel 22 being rotated. The ball 27, which reaches the wheel 22, continues to pass over the numbered plates 25 at the periphery of the wheel 22 and is introduced into one of the numbered pockets 23 and the number (any one of "00", "0" and "1"~"36") shown on the numbered plate 25 corresponding to the numbered pocket 23 into which the ball 27 is introduced becomes a winning number.

When the roulette lottery process is carried out as described above, a bet information signal is received from the station 4 (C5). The bet-number and the bet type included in the bet information signal are registered in the station management table (C6). Then, it is determined whether the bet time is over (C7). When it is determined that the bet time is not over (C7, NO), the wait state continues until the bet time is over. In the mean time, when it is determined that the bet time is over (C7, YES), a bet time end signal is transmitted to the station 4 (C8).

Then, a jackpot accumulation process is executed (C9). To be more specific, the bet information made by a player in each of the stations 4, i.e., the information of the indicated bet area 72 and the number of chips (bet-number) bet on the indicated bet area 72 and the bet type is received and stored in the bet information memory area of the RAM 83. Then, the credits, which correspond to 0.5% of the total credits bet in the respective stations 4, are accumulated and added to the JP amount that is recorded in the JP accumulation memory area 83V of the RAM 83. Correspondingly to this, the display of the JP amount indicator 15 and the JP indicator 73 is updated.

Then, when the ball 27 is received in the numbered pocket 23 in the roulette apparatus 3, a prize winning determining apparatus 86 is driven. Thereby, it is detected a winning number of the roulette apparatus 3 in this time game (C10).

Then, the winning number signal including the information of the winning number is transmitted to the respective stations 4 (C11). Then, the bet information and the winning number of the respective stations 4 are used to determine whether the chips bet in the respective stations 4 are determined as a prize winning (C12). Continuously, a payout calculation process is executed. In the payout calculation process, the won chips bet on the winning number are recognized for each station 4 and a sum of the payouts of the credits to be paid out to the respective stations 4 is calculated with the payout rates for each bet area 72, which are stored in the ROM 82 in a payout management table form, i.e., the credit-number to be paid out per one chip (one bet) (C13).

Then, it is executed a process of transmitting a payout result signal including a payout result of the credits of the roulette game, based on the payout calculation process. To be more specific, the payout result signal including the credit data of a base payout corresponding to the payout amount of the roulette game is transmitted to the station control CPU 91 of the station 4 that is determined to be a prize winning in the roulette game (C14).

Then, the ball collection apparatus provided below the wheel 22 is driven, so that the ball 27 on the wheel 22 is collected. The collected ball 27 is adapted to be inserted in the wheel 22 of the roulette apparatus 3 in a next or more game (C15). Then, a unit game end signal is transmitted to the station 4 (C16) and this routine is ended.

Although the above descriptions have been provided with regard to the characteristic parts so as to understand the invention more easily, the invention is not limited to the embodiment as described above and can be applied to the other embodiments and the applicable scope should be construed as broadly as possible. Furthermore, the terms and phraseology used in the specification have been used to correctly illustrate the invention, not to limit it. In addition, it will be understood by those skilled in the art that the other structures, systems, methods and the like included in the spirit of the invention can be easily derived from the spirit of the invention described in the specification. Accordingly, it should be considered that the invention covers equivalent structures thereof without departing from the spirit and scope of the invention as defined in the following claims. Further, the abstract is provided so that an intellectual property office and a general public institution or one skilled in the art who is not familiar with patent and legal or professional terminology can quickly analyze the technical features and essences of the invention through a simple investigation. Accordingly, the abstract is not intended to limit the scope of the invention that should be evaluated by the claims. In addition, it is required to sufficiently refer to the documents that have been already disclosed, so as to fully understand the objects and effects of the invention.

The above descriptions include a process that is executed on a computer or computer network. The above descriptions and expressions have been provided so that the one skilled in the art can understand the invention most effectively. In the specification, the respective steps used to induce one result or blocks having a predetermined processing function should be understood as a process having no self-contradiction. In addition, the electrical or magnetic signal is transmitted/received and written in the respective steps or blocks. Although the processes in the respective steps or blocks embody the signal as a bit, value, symbol character, term, number and the like, it should be noted that these have been used for the convenience of descriptions. Further, although the processes in the respective steps or blocks have been often described as an expression common to a human action, the process described in the specification is executed by a variety of devices in principle. In addition, the other structures necessary for the respective steps or blocks are apparent from the above descriptions.

What is claimed is:

1. A gaming machine comprising:

a game in which a plurality of different marks are displayed, a player makes a bet for bet elements based on the plurality of marks during a bet time period, and a game result of the player is determined based on bet elements for which the player makes the bet after the bet time period is over;

an image display apparatus configured to display a bet screen having a plurality of bet areas;

a memory device configured to store a bet pattern into which a plurality of bet elements are combined;

a bet element receiving apparatus configured to individually receive a selection of the bet elements during the bet time period;

a plurality of bet pattern receiving apparatuses each configured to receive a selection of the bet pattern during the bet time period, the bet areas and an area for the selection of the bet pattern being displayed as the bet screen on the image display apparatus; and a controller configured to:

(c1) after the bet time period is over, store a bet pattern into which the bet elements selected during the bet time period are combined in the memory device so as to correspond to one which is selected by the player from among the bet pattern receiving apparatuses;

(c2) receive a selection of one of the bet element receiving apparatuses and the bet pattern receiving apparatuses during the bet time period;

(c3) when the bet element receiving apparatus is selected, make a bet of the bet pattern using the selected bet element received by the bet element receiving apparatus; and (c4) when one of the bet pattern receiving apparatuses is selected, (i) display a pattern check screen on the bet screen (ii) receive, via the pattern check screen, a selection of any one of a bet of the bet pattern and a cancellation of the bet pattern, and (iii) make the bet of the bet pattern, in the event the selection of the bet is received, wherein the pattern check screen comprises a plurality of virtual bet areas that correspond to the bet areas of the bet screen, respectively, and the pattern check screen displays on the virtual bet areas chips to be betted according to bet elements included in the bet pattern which corresponds to the selected bet pattern receiving apparatuses.

2. A gaming machine comprising:

a game in which a plurality of different marks are displayed, a player makes a bet for bet elements based on the plurality of marks during a bet time period, and a game result of the player is determined based on bet elements for which the player makes the bet after the bet time period is over;

an image display apparatus configured to display a bet screen having a plurality of bet areas;

a memory device configured to store a bet pattern into which a plurality of bet elements are combined;

a bet element receiving apparatus configured to individually receive a selection of the bet elements of the bet pattern during the bet time period;

a plurality of bet pattern receiving apparatuses each configured to receive a selection of the bet pattern during the bet time period, the bet areas and an area for the selection of the bet pattern being displayed as the bet screen on the image display apparatus;

a plurality of bet pattern indicating apparatuses which correspond to plurality of bet pattern receiving apparatuses, respectively; and a controller configured to:

(d1) after the bet time period is over, store in the memory device a bet pattern into which the bet elements selected during the bet time period are combined so as to correspond to one which corresponds to any one of the bet pattern indicating apparatuses from among the bet pattern receiving apparatuses, by an operation of said any one of the bet pattern indicating apparatuses by the player;

(d2) receive a selection of one of the bet element receiving apparatus and the respective bet pattern receiving apparatuses during the bet time period;

(d3) when the bet element receiving apparatus is selected, make a bet of the bet pattern using the selected bet element received by the bet element receiving apparatus; and (d4) when one of the bet pattern receiving apparatuses is selected, (i) display a pattern check screen on the bet screen, (ii) receive, via the pattern check screen, a selection of any one of a bet of the bet pattern and a cancellation of the bet pattern, and (iii) make the bet of the bet pattern, in the event the selection of the bet is received, wherein the pattern check screen comprises a plurality of virtual bet areas that correspond to the bet areas of the bet screen, respectively, and the pattern check screen displays on the virtual bet areas chips to be betted according to bet elements included in the bet pattern which corresponds to the selected bet pattern receiving apparatuses.

3. The gaming machine according to claim 2, wherein the game is a multiplayer-type game that allows participation of two or more players.

4. The gaming machine according to claim 3, wherein the game is one of a roulette game, a horse race game, a motorboat race game and a bicycle race game.

5. A method of controlling a gaming machine having a controller, comprising the steps of:

via the controller, displaying a bet screen having a plurality of bet areas on an image display apparatus;

via the controller, allowing a player to make a bet, thereby performing a game in which a plurality of different marks are displayed, the player makes the bet for bet elements based on the plurality of marks during a bet time period, and a game result of the player is determined based on bet elements for which the player makes the bet after the bet time period is over;

storing in a memory device a bet pattern into which a plurality of bet elements are combined, wherein after the bet time period is over, a bet pattern into which the bet elements selected during the bet time period are combined in the memory device so as to correspond to one which is selected by the player from among a plurality of bet pattern receiving apparatuses;

via the controller, receiving a selection of one of the bet element and the bet pattern during the bet time period, the bet areas and an area for the selection of the bet pattern being displayed as the bet screen on the image display apparatus;

when the bet element is selected, making a bet, via the controller, of the bet pattern using the bet element selected; and when the bet pattern is selected, via the controller, (i) displaying on the bet screen a pattern check screen displaying, as a selected bet pattern, the bet elements of the bet pattern which is corresponding to the selected one of the bet pattern receiving apparatuses and stored in the memory device, (ii) receiving, via the pattern check screen, a selection of any one of a bet of the bet pattern and a cancellation of the bet pattern, and (iii) making the bet of the bet pattern, in the event the selection of the bet is received, wherein the pattern check screen comprises a plurality of virtual bet areas that correspond to the bet areas of the bet screen, respectively, and the pattern check screen displays on the virtual bet areas chips to be betted according to bet elements included in the bet pattern which corresponds to the selected bet pattern receiving apparatuses.

6. The gaming machine according to claim 1, wherein the controller operates to limit the amount of time available to make a bet.

7. The gaming machine according to claim 1, wherein the controller is configured to execute a process of registering a bet pattern comprising a bet pattern registration screen and performing a pattern registering process in which a bet is regarded as a non-actual bet but an imitation bet upon a pattern imitation button being pressed, with the pattern registration process being performed within a controlled bet time and the pattern registration process ending upon the controlled bet time elapsing.

8. The gaming machine according to claim 2, wherein the controller operates to limit the amount of time available to make a bet.

9. The gaming machine according to claim 2, wherein the controller is configured to execute a process of registering a bet pattern comprising a bet pattern registration screen and performing a pattern registering process in which a bet is regarded as a non-actual bet but an imitation bet upon a pattern imitation button being pressed, with the pattern registration process being performed within a controlled bet time and the pattern registration process ending upon the controlled bet time elapsing.

10. The gaming machine according to claim 3, wherein the controller operates to limit the amount of time available to make a bet.

11. The gaming machine according to claim 3, wherein the controller is configured to execute a process of registering a bet pattern comprising a bet pattern registration screen and performing a pattern registering process in which a bet is regarded as a non-actual bet but an imitation bet upon a pattern imitation button being pressed, with the pattern registration process being performed within a controlled bet time and the pattern registration process ending upon the controlled bet time elapsing.

12. The gaming machine according to claim 4, wherein the controller operates to limit the amount of time available to make a bet.

13. The gaming machine according to claim 4, wherein the controller is configured to execute a process of registering a bet pattern comprising a bet pattern registration screen and performing a pattern registering process in which a bet is regarded as a non-actual bet but an imitation bet upon a pattern imitation button being pressed, with the pattern registration process being performed within a controlled bet time and the pattern registration process ending upon the controlled bet time elapsing.

14. The method of controlling a gaming machine according to claim 5, wherein the method includes a bet pattern registration process that is executed by the controller and in which a bet pattern registration screen is caused to be displayed on a display associated with the gaming machine, with a bet being regarded as a non-actual bet but an imitation bet upon a pattern imitation button being pressed and with the pattern registration process being performed within a controlled bet time and the pattern registration process ending upon the controlled bet time elapsing.

* * * * *